US008292365B2

(12) United States Patent
Lu et al.

(10) Patent No.: US 8,292,365 B2
(45) Date of Patent: Oct. 23, 2012

(54) CHILD CHAIR

(75) Inventors: Mulin Lu, Taipei (TW); Hong-Bo Chen, Taipei (TW); Fu-Sian Yu, Taipei (TW); Chih-Wei Wang, Taipei (TW)

(73) Assignee: Excellerate Enterprise Co., Ltd., Songshan District, Taipei (TW)

( * ) Notice: Subject to any disclaimer, the term of this patent is extended or adjusted under 35 U.S.C. 154(b) by 246 days.

(21) Appl. No.: 12/350,973

(22) Filed: Jan. 9, 2009

(65) Prior Publication Data

US 2009/0189422 A1 Jul. 30, 2009

Related U.S. Application Data

(60) Provisional application No. 61/020,148, filed on Jan. 10, 2008, provisional application No. 61/030,568, filed on Feb. 22, 2008, provisional application No. 61/051,679, filed on May 9, 2008.

(51) Int. Cl.
*A47C 1/00* (2006.01)

(52) U.S. Cl. ..... 297/327; 297/325; 297/326

(58) Field of Classification Search ..... 297/256, 297/13, 270.1, 270.3, 270.4, 300.6, 300.7, 297/300.8, 326, 327, 328, DIG. 11
See application file for complete search history.

(56) References Cited

U.S. PATENT DOCUMENTS

| | | | | |
|---|---|---|---|---|
| 1,755,215 | A | 4/1930 | Glass | |
| 4,634,177 | A * | 1/1987 | Meeker | 297/256.13 |
| 5,575,530 | A | 11/1996 | Harper | |
| 5,863,097 | A * | 1/1999 | Harper et al. | 297/260.2 |
| 5,899,530 | A * | 5/1999 | Tedesco | 297/328 |
| 6,161,898 | A * | 12/2000 | Brevi | 297/328 |
| 6,854,799 | B1 * | 2/2005 | Asbach et al. | 297/136 |
| 7,008,018 | B2 * | 3/2006 | Chen | 297/363 |
| 7,066,542 | B2 * | 6/2006 | Wang | 297/376 |
| 2001/0028184 | A1 | 10/2001 | Sitarski | |
| 2008/0088161 | A1 * | 4/2008 | Fritz et al. | 297/256.13 |

FOREIGN PATENT DOCUMENTS

| | | |
|---|---|---|
| GB | 2 343 623 A | 5/2000 |
| GB | 2 414 389 A | 11/2005 |

* cited by examiner

*Primary Examiner* — David Dunn
*Assistant Examiner* — Philip Gabler
(74) *Attorney, Agent, or Firm* — Winston Hsu; Scott Margo

(57) ABSTRACT

A child chair includes a seat, a frame, a reclining adjusting device, a locking device, and a bouncing device. The seat pivoted with the frame. The reclining adjusting device mounted on the seat capable of moving between a locking status and a release status, the seat movable relative to the frame when the reclining adjusting device is in the release status. The locking device mounted on the seat for retaining the reclining adjusting device in the release status. The bouncing device mounted between the seat and the frame for bouncing the seat along a direction relative to the frame when the reclining adjusting device is retained in the release status by the locking device.

25 Claims, 21 Drawing Sheets

CHILD CHAIR

CROSS REFERENCE TO RELATED APPLICATIONS

This application claims the benefit of U.S. Provisional Application No. 61/020,148, No. 61/030,568, and No. 61/051,679, filed on Jan. 10, 2008, Feb. 22, 2008, and May 9, 2008 and all entitled "HIGH CHAIR" the contents of which are incorporated herein by reference.

BACKGROUND OF THE INVENTION

1. Field of the Invention

The present invention relates to a child chair, and more particularly, to a child chair is convertible between a high chair and a bouncing chair.

2. Description of the Prior Art

It is quite common that babies or toddlers sit in a child chair for being taken care of by adults when they are placed at the dining table for feeding. Child chairs in the prior art, however, are rich in structural variety but not versatile in functions, most of them simply for dining purpose. It is very inconvenient for users to call for other functions, for example, user has to buy another chair for bouncing function in a conventional sit-only child chair.

SUMMARY OF THE INVENTION

It is an objective of the present invention to provide a child chair with function of high chair function and bouncing chair. The other objective of the present invention provides a child chair which is convertible between a high chair and bouncing chair.

A child chair includes a seat, a frame, a reclining adjusting device, a locking device, and a bouncing device. The seat is pivoted with the frame. The reclining adjusting device is mounted on the seat capable of moving between a locking status and a release status, the seat movable relative to the frame when the reclining adjusting device is in the release status. The locking device is mounted on the seat for retaining the reclining adjusting device in the release status. The bouncing device is mounted between the seat and the frame for bouncing the seat along a direction relative to the frame when the reclining adjusting device is retained in the release status by the locking device.

A child chair includes a frame, a seat, a device and a bouncing device. The seat is pivoted with the frame. The device is mounted on the seat selectively moved between a first position and a second position, the seat is capable move relative to the frame when the device is in the second position. The bouncing device mounted between the seat and the frame. When the device is in the second position, the seat is bounced relative the frame by the bouncing device while the seat is provided with a force.

A child chair includes a frame, a seat, a bouncing device, and a locking device. The seat is pivoted with the frame. The bouncing device is mounted between the seat and the frame. The locking device is mounted on the seat and movable between a retained position and an unretained position for converting the child chair between a bouncing chair and a high chair.

These and other objectives of the present invention will no doubt become obvious to those of ordinary skill in the art after reading the following detailed description of the preferred embodiment that is illustrated in the various figures and drawings.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
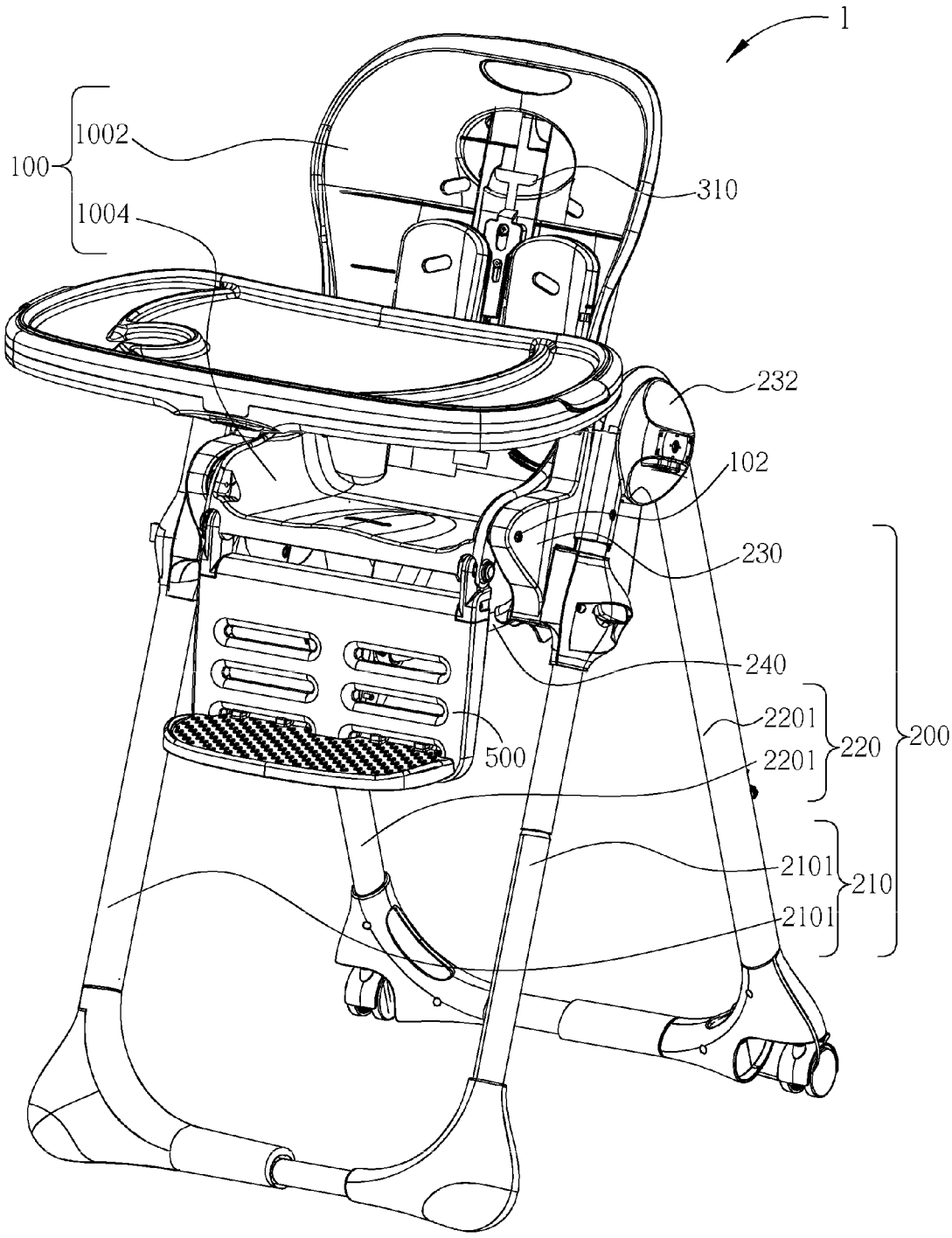
FIG. 1 is an anterior lateral view of a child chair according to the present invention.
Figure 2:
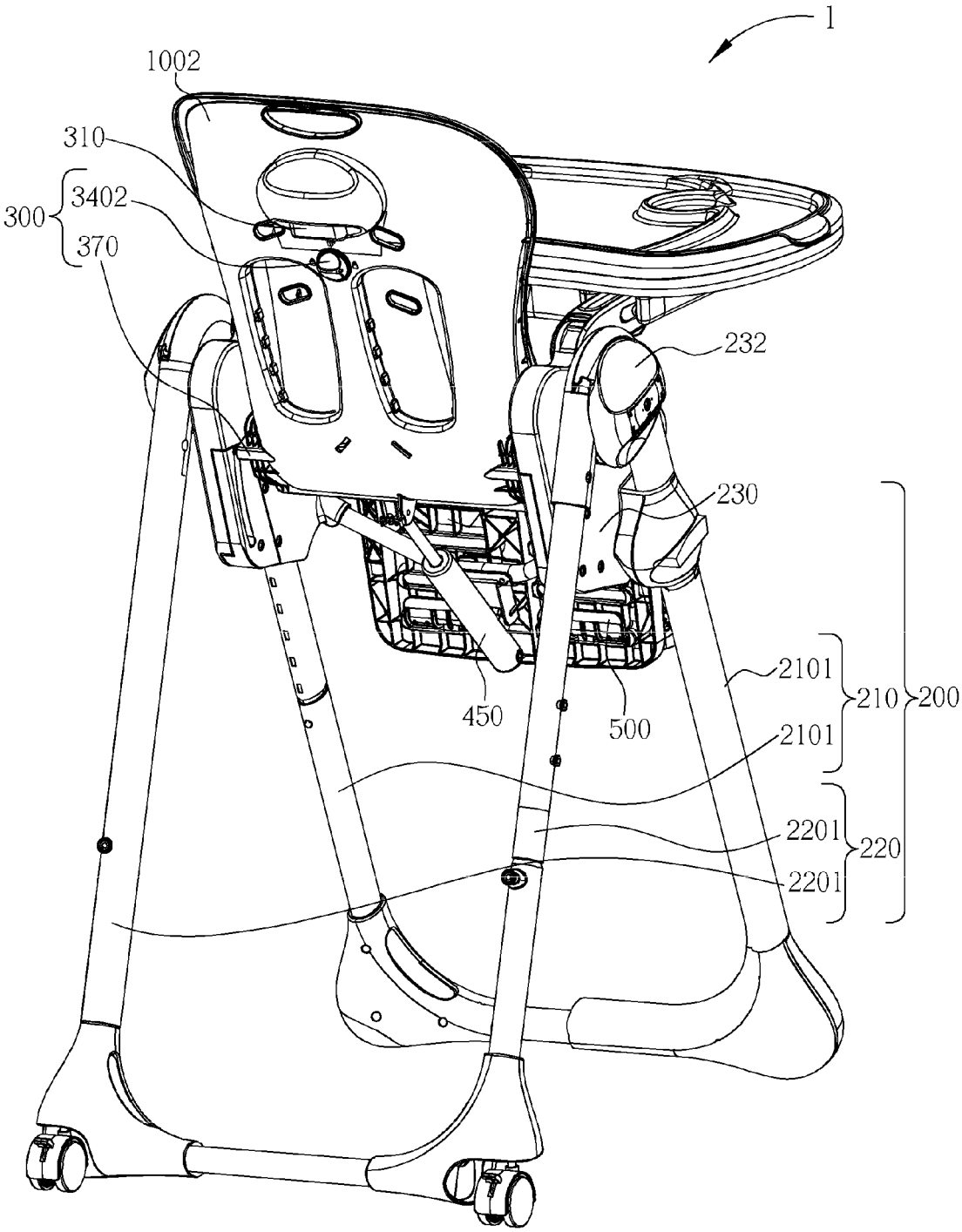
FIG. 2 is a posterior lateral view of the child chair according to the present invention.

Please refer to FIG. 1 and FIG. 2. FIG. 1 is an anterior lateral view of a child chair 1 according to the present invention. FIG. 2 is a posterior lateral view of the child chair 1 according to the present invention. The child chair 1 includes a seat 100, a frame 200, a reclining adjusting device 300, and a bouncing device 450. The frame 200 includes a front leg frame 210, a rear leg frame 220, two seat couplers 230 and a support tube 240. The front leg frame 210 includes two front leg tubes 2101, and the rear leg frame 220 includes two rear leg tubes 2201. Each rear leg tube 2201 is pivoted to the correspondent front leg tube 2101 by a coupler 232. The seat couplers 230 are respectively disposed on two front leg tubes 2101 of the front leg frame 210. The seat 100 includes a backrest 1002 and a seat body 1004. The seat 100 is pivoted between the two seat couplers 230 by a pivot axis 102 and the pivot axis 102 is rotating point when the seat 100 is moved relative to the frame 200. Besides, the reclining adjusting device 300 is mounted between the seat 100 and the frame 200. The bouncing device 450 is connected between the seat 100 and the frame 200. The support tube 240 is connected with the two seat couplers 230 for supporting the seat 100 and increasing the stability of the child chair 1.

The reclining adjusting device 300 in this embodiment includes an actuator 310 and an engaging device 370. The reclining adjusting device 300 is selective to be set at a locking status and a release status by a locking device 3402. The seat 100 is free to move to a predetermined reclined angle relative to the frame 200 when the reclining adjusting device 300 is in the releasing status and locked in the predetermined reclined angle when the reclining adjusting device 300 is in the locking status. The seat 100 can be bounced along a direction relative to the frame 200 when the reclining adjusting device 300 is retained in the release status by the locking device 3402. The child chair 1 includes a foot rest 500, which is pivoted below the seat 100 for providing comfort to a baby.

Figure 3:
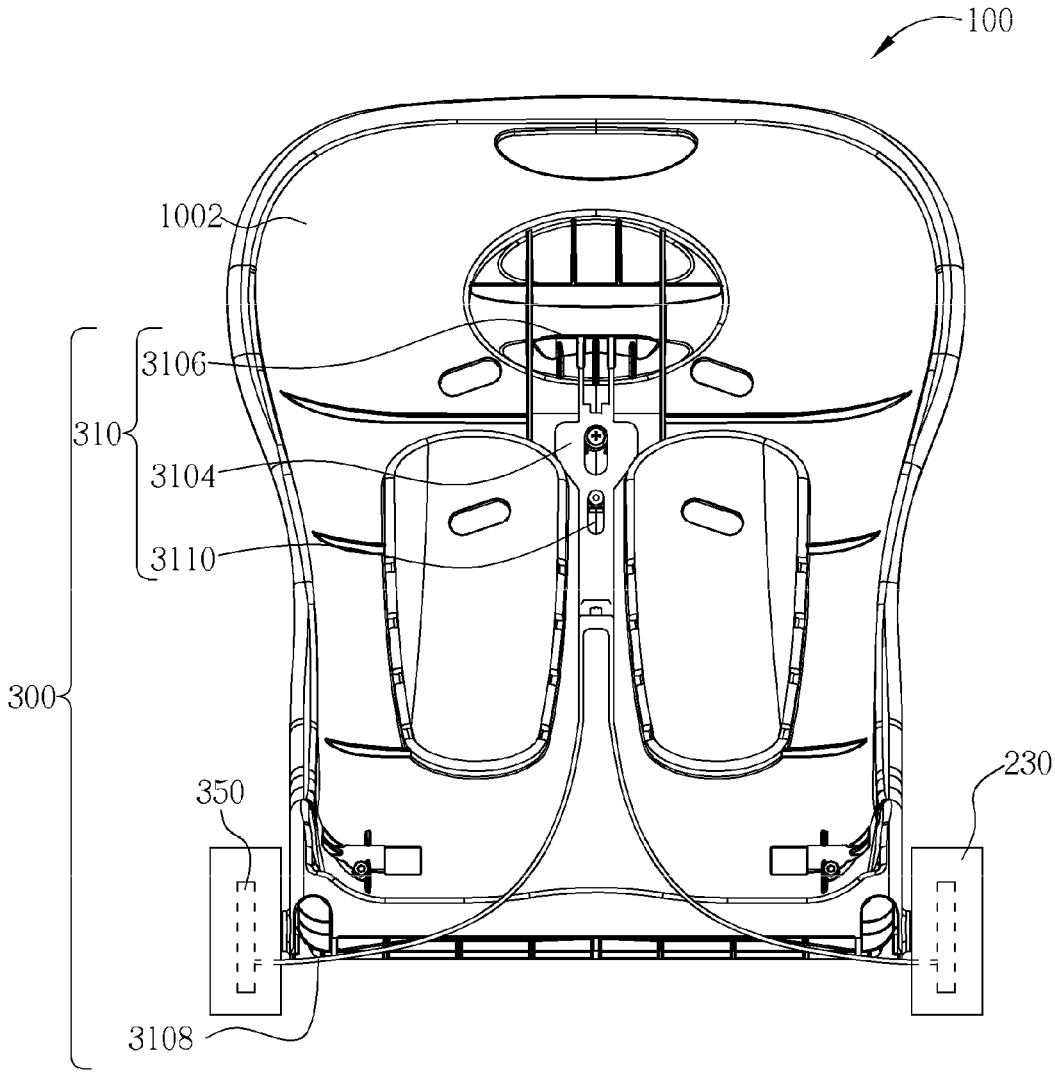
FIG. 3 is a diagram of a first embodiment of a reclining adjusting device according to the present invention.
Figure 4:
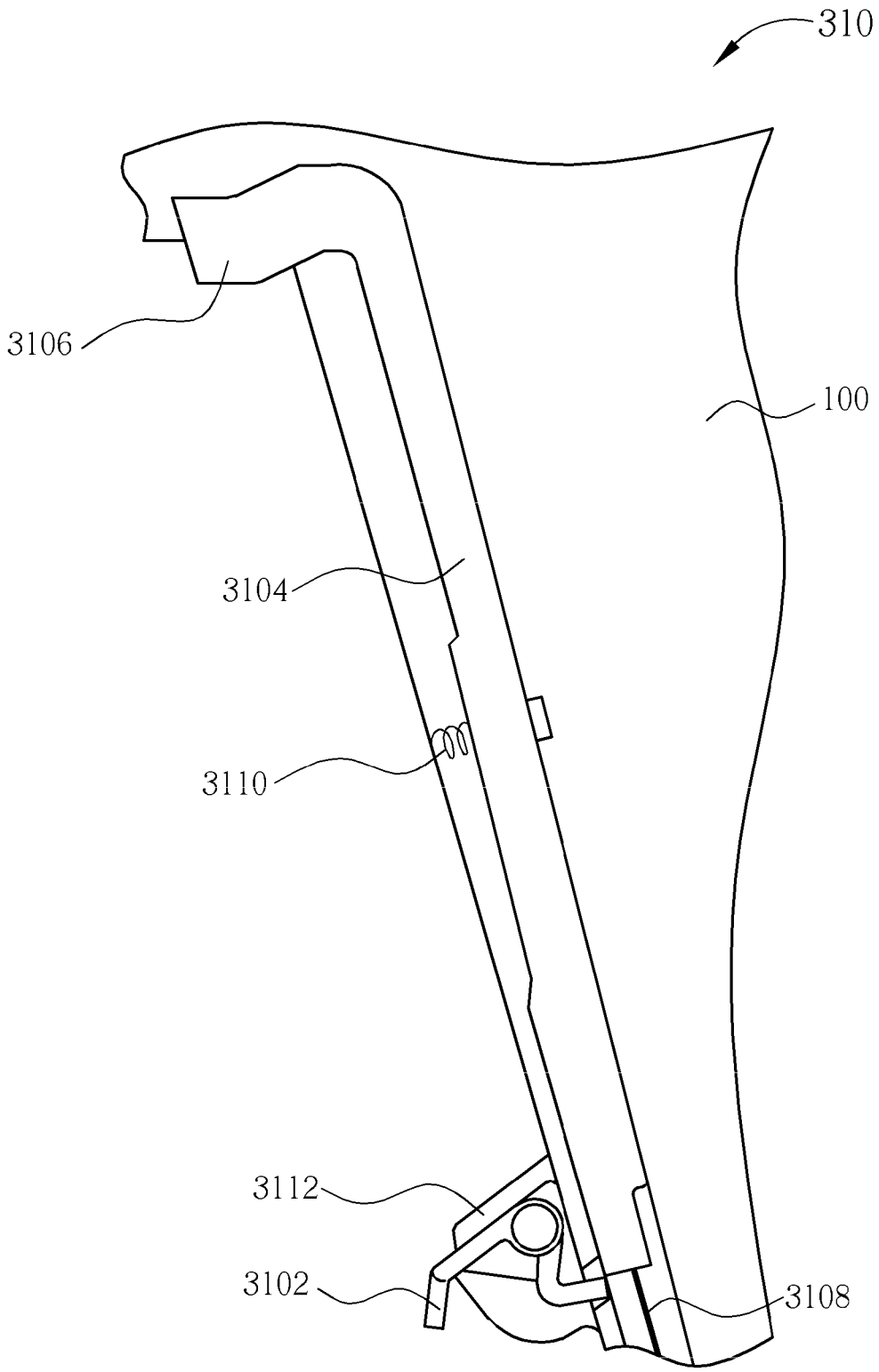
FIG. 4 is a diagram of the first embodiment of a locking device and an actuator according to the present invention.
Figure 5:
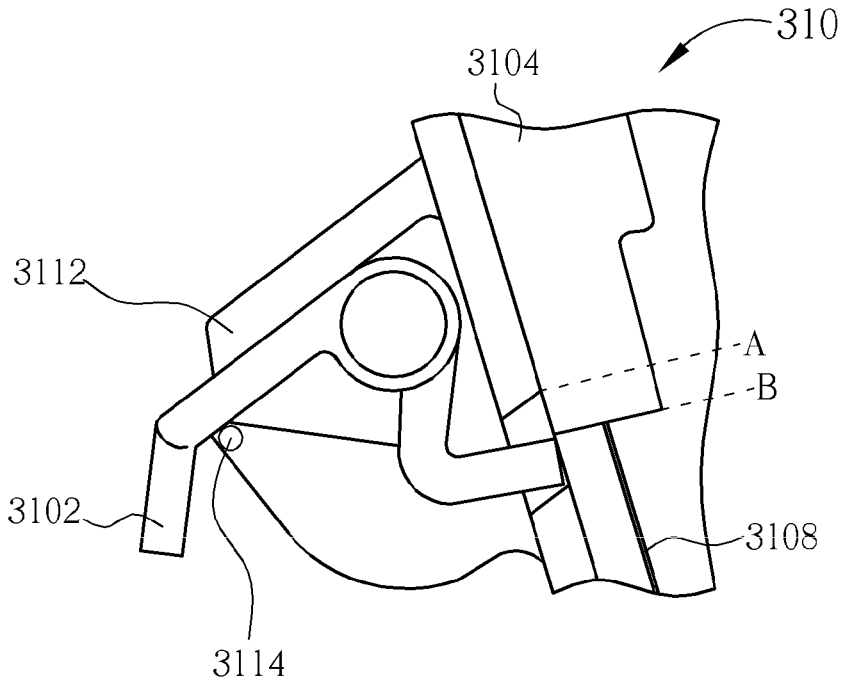
FIG. 5 is a partial-enlarged diagram of the actuator in a release status according to the present invention.
Figure 6:
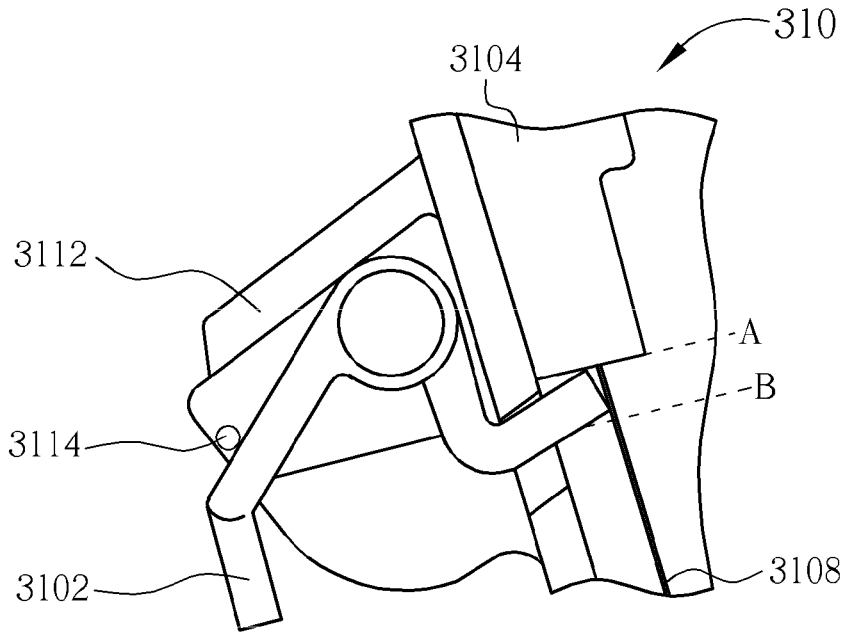
FIG. 6 is a partial-enlarged diagram of the actuator in a locking status according to the present invention.
Figure 7:
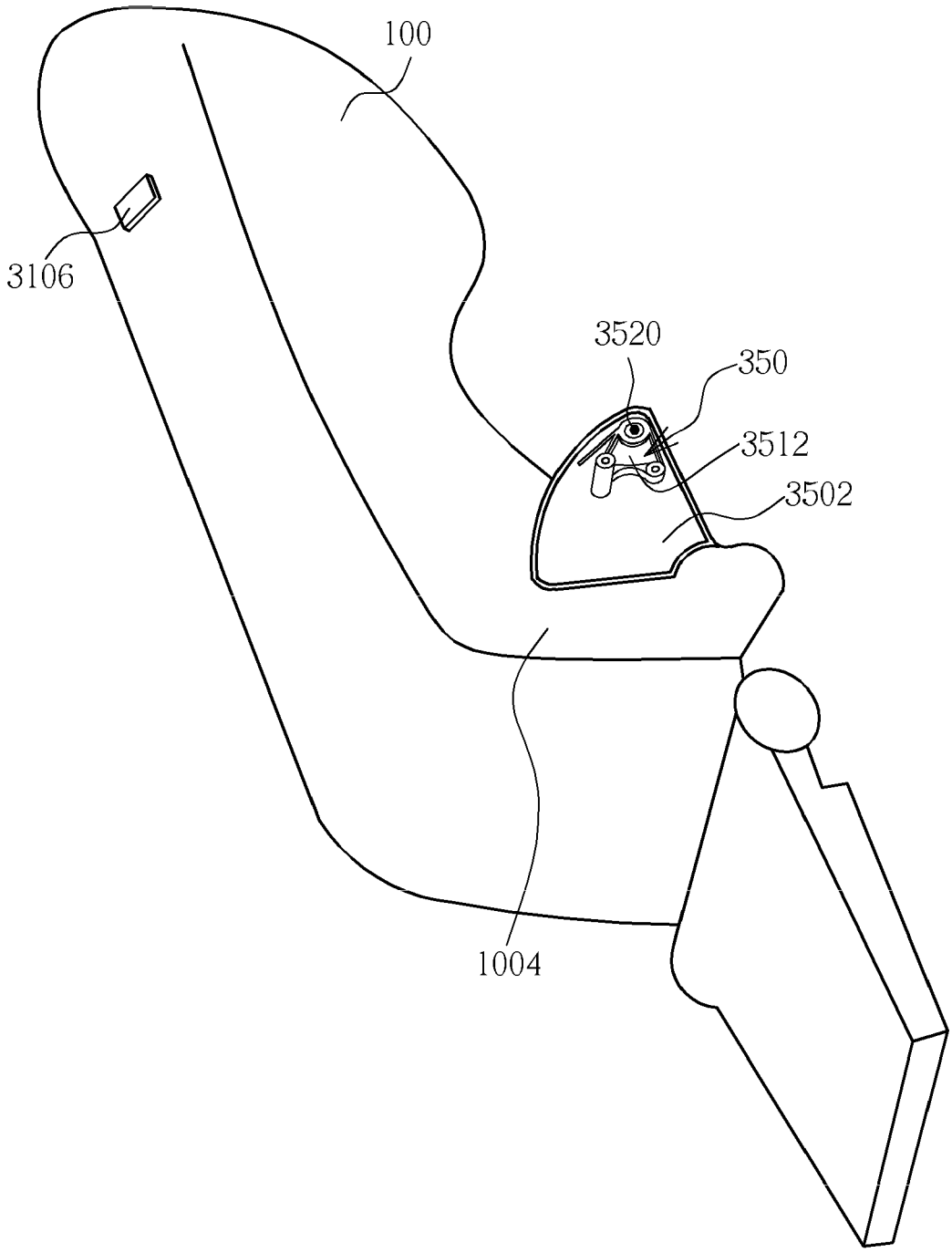
FIG. 7 is a diagram of the first embodiment of the engaging device according to the present invention.
Figure 8:
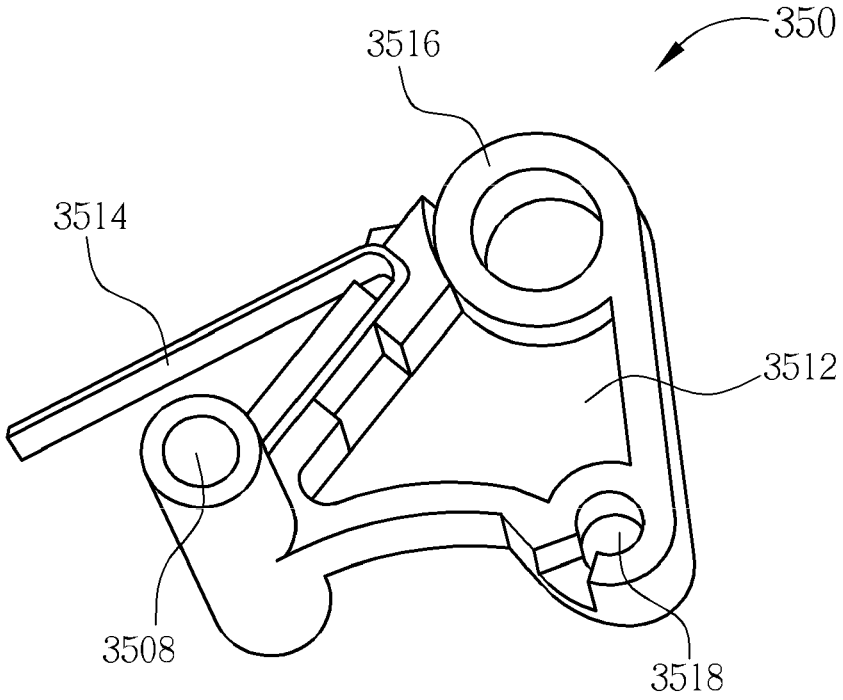
FIG. 8 is a partial-enlarged diagram of the engaging device according to the present invention.
Figure 9:
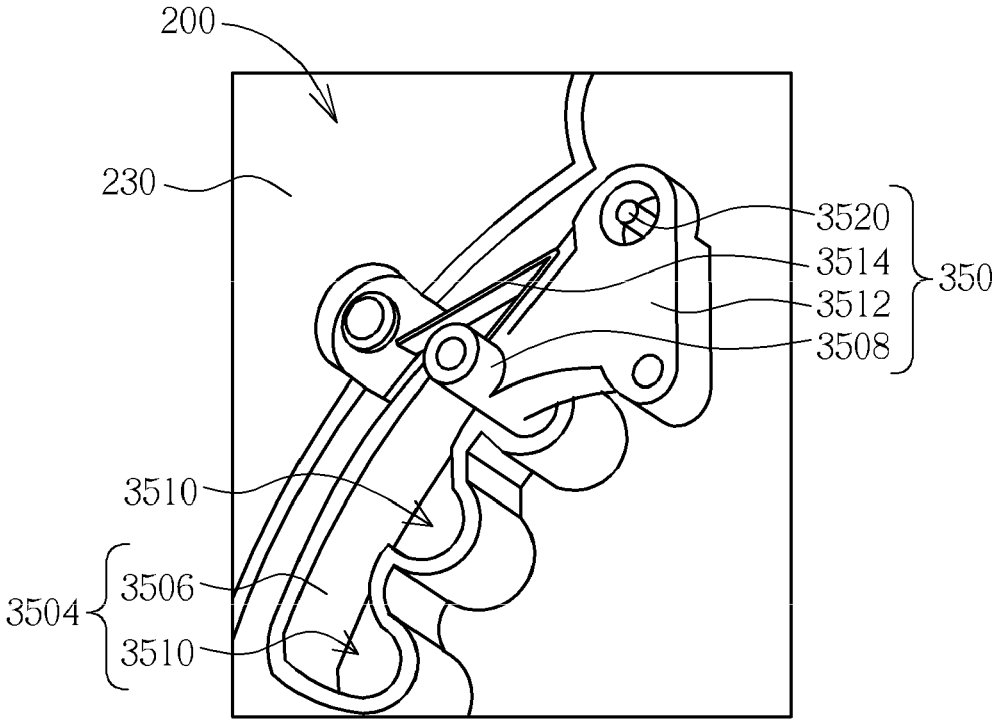
FIG. 9 is a partial-enlarged diagram of the engaging device and a frame according to the present invention.

Please refer to FIG. 3 to FIG. 9 showing a first embodiment of the reclining adjusting device. FIG. 3 is a diagram of the engaging device 350 and actuator 310 according to the present invention. FIG. 4 is a diagram of the locking device 3102 and the actuator 310 according to the present invention. FIG. 5 is a partial-enlarged diagram of the actuator 310 in the release status according to the present invention. FIG. 6 is a partial-enlarged diagram of the actuator 310 in the locking status according to the present invention. FIG. 7 is a diagram of the engaging device 350 according to the present invention. FIG. 8 is a partial-enlarged diagram of the engaging device 350 according to the present invention. FIG. 9 is a partial-enlarged diagram of the engaging device 350 and the frame 200 according to the present invention. Referring to FIG. 3 to FIG. 7, the seat 100 is pivoted with the frame 200 by the pivot axis 102. The actuator 310 is mounted on the seat 100, and includes a drag rod 3104 having an operating portion 3106 at the top. The actuator 310 is mounted at the upper portion of the backrest 1002 of the seat 100 for operating convenience to a user. The engaging device 350 is mounted at the two sides of the seat body 1004 and near the seat couplers 230 of the frame 200. Additionally, the engaging device 350 is connected to the actuator 310 via a cable 3108 which is mounted below the drag rod 3104.

The child chair 1 further includes a locking device 3102 (shown in FIG. 4) that can selectively retain the reclining adjusting device 300 at the locking status and the release status so as to switch the child chair 1 between a high chair and a bouncing chair. The locking device 3102 is a rotating plate in the first embodiment of the present invention. The locking device 3102 is pivotally connected to an adjusting seat 3112 at the back of the backrest 1002 of the seat 100 and is mounted near the bottom of the drag rod 3104. The locking device 3102 is rotatable between a retained position (shown in FIG. 6) and an unretained position (shown in FIG. 5). The inside of the adjusting seat 3112 includes a prominence 3114 for retaining the locking device 3102 in the retained position or the unretained position.

Please refer to FIG. 7. A cover 3502 is formed on the two sides of the seat body 1004 of the seat 100, and the seat coupler 230 of the frame 200 includes an angle adjusting device 3504. Please refer to FIG. 9. The angle adjusting device 3504 includes a slide way 3506 and a plurality of slots 3510 which is located at a side of the slide way 3506 and is communicated with the slide way 3506. Please refer to FIG. 8. The engaging device 350 includes an elastic part 3514 and an adjusting part 3512 which is substantially triangular and includes a first end 3516, a second end 3518, and a third end 3508 that is realized as an adjusting pin in this embodiment. As shown in FIG. 9, the first end 3516 is pivoted to the cover 3502 by a bolt 3520. The adjusting pin 3508 is slidable in the slide way 3506 and is engagable with one of the slots 3510 (shown in FIG. 9). The second end 3518 is linked with the drag rod 3104 by the cable 3108 so as to connect the engaging device 350 and the actuator 310 (shown in FIG. 6 and FIG. 8). The elastic part 3514 is V-shape in this embodiment. The end of the elastic part 3514 is coupled to the adjusting part 3512, and another end is abutted against the rim of the cover 3502 for providing elasticity to the adjusting part 3512 so as to press the adjusting pin 3508 enter to one of the slots 3510.

Figure 10:
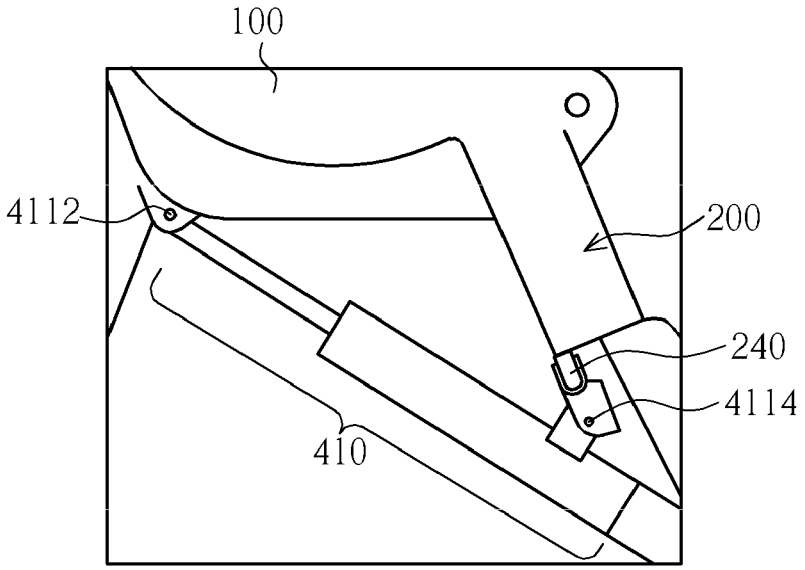
FIG. 10 is a diagram of the first embodiment of a bouncing device according to the present invention.
Figure 11:
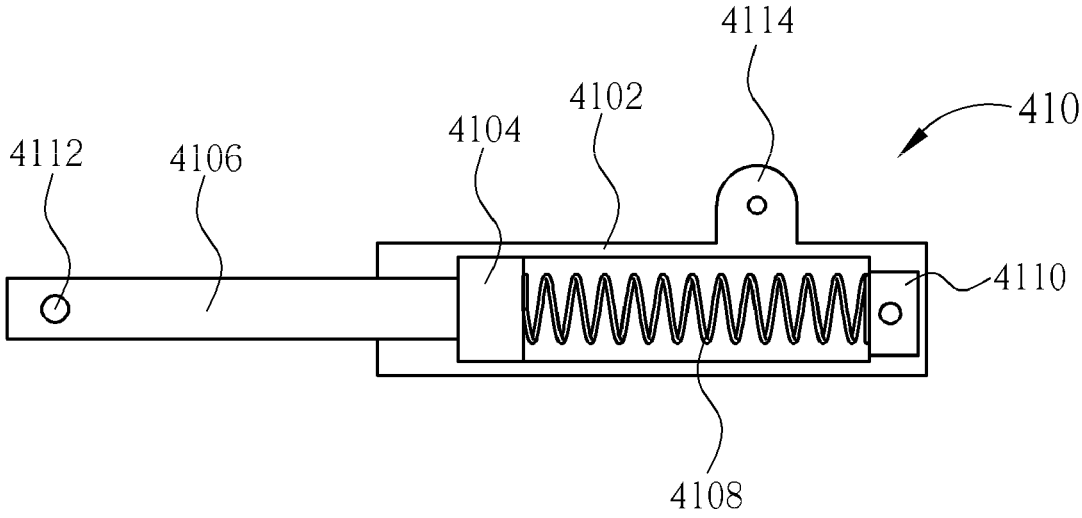
FIG. 11 is a fragmentary sectional view of the bouncing device according to the present invention.

Please refer to FIG. 10 and FIG. 11 showing the bouncing device 410. FIG. 10 is a diagram of the first embodiment of the bouncing device 410 according to the present invention. FIG. 11 is a fragmentary sectional view of the bouncing device 410 according to the present invention. The first embodiment of the bouncing device 410 includes a sleeve 4102, a column 4106, and a spring 4108. The sleeve 4102 includes a second pivot point 4114 and a fixed cover 4110. The fixed cover 4110 is mounted on the bottom of the sleeve 4102, and the second pivot point 4114 is pivoted with the support tube 240 of the frame 200 by a fastening element, for example, a rivet (not shown in FIG. 11). The end of the column 4106 includes a first pivot point 4112, which is pivoted with the seat 100 by the fastening element (not shown in FIG. 11), and another end of the column 4106 includes a piston 4104, which is movably mounted in the sleeve 4102. Additionally, the spring 4108 is a compression spring in this embodiment. The end of the spring 4108 is connected to the piston 4104, and the other end of the spring 4108 is fixed in the fixed cover 4110.

Referring to FIG. 5 to FIG. 9, for the child chair 1 is used as a bouncing chair, the drag rod 3104 of the actuator 310 is retained at a first position A by the locking device 3102 when the locking device 3102 is in the retained position as shown in FIG. 6. The adjusting pin 3508 of the engaging device 350 is deviated from one of the slots 3510 of the frame 200 and into the slide way 3506. The child chair 1 is pressed by the child sitting thereon or the parents and forced to bounce relative to the frame 200 by the spring 4108 of the bouncing device 410 and the seat 100 is rotated relative to the frame 200 via the pivoted axle 102 (shown in FIG. 12 and FIG. 13). When the locking device 3102 is located at the unretained position (shown in FIG. 5), the drag rod 3104 goes back to the second position B by an elastic element 3110 which is connected to the seat 100 and the drag rod 3104. The seat 100 is retained at a reclining position relative to the frame 200 because the engaging device 350 is engaged with the frame 200. The seat 100 will secured to the frame 200 even it is forced by a user.

Figure 13:
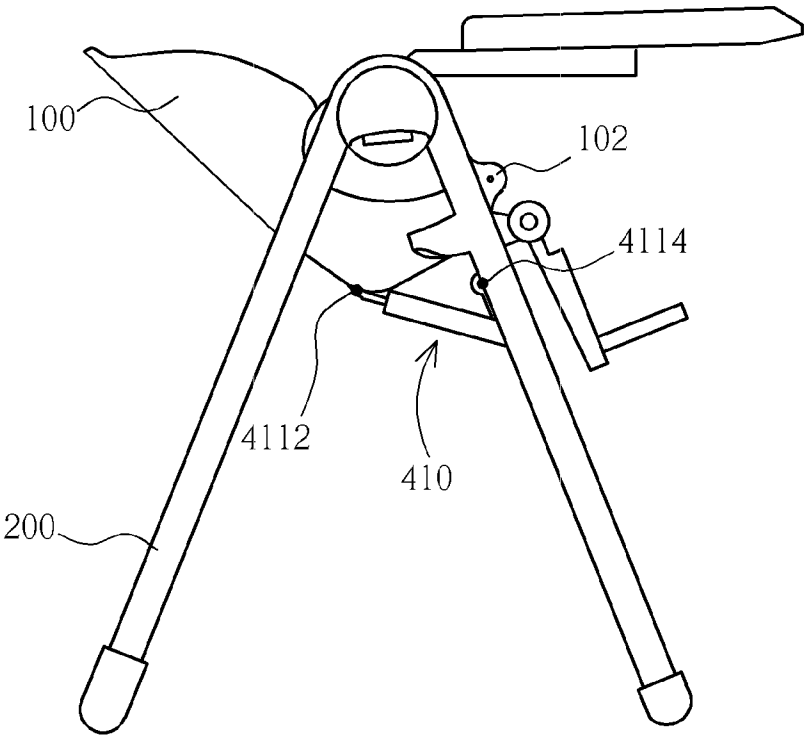
FIG. 13 is a diagram of the first embodiment of the bouncing device according to the present invention before bounced.
Figure 12:
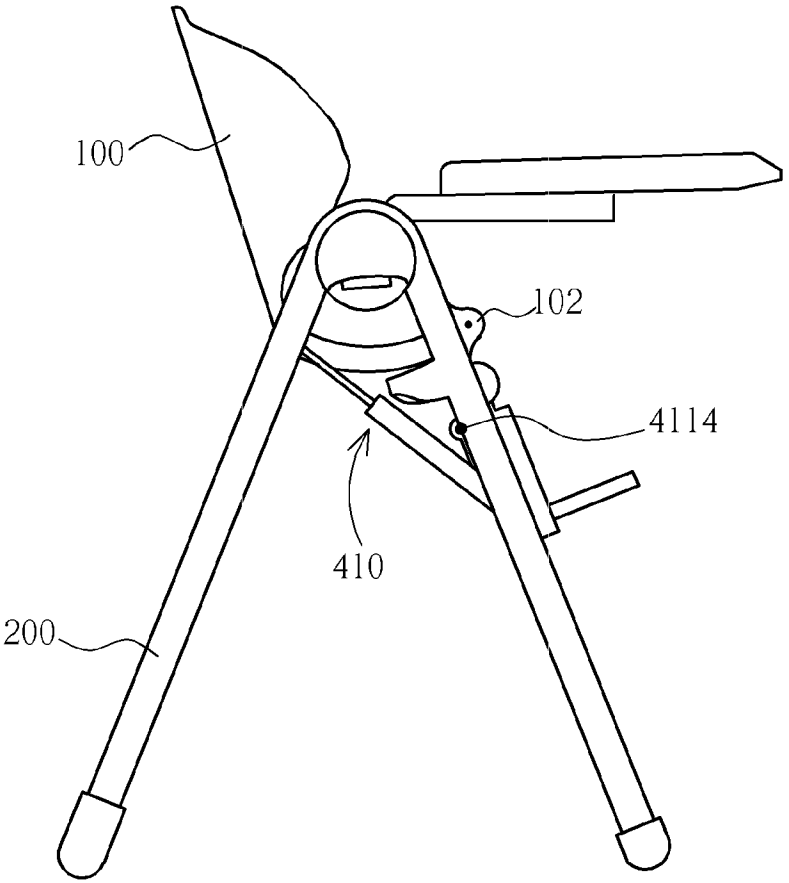
FIG. 12 is a fragmentary exploded of a second embodiment of the bouncing device according to the present invention.

Please refer to FIG. 12 and FIG. 13 showing a diagram when the bouncing device 410 performs bouncing function. FIG. 12 is a diagram of the bouncing device 410 according to the present invention before bounced. FIG. 13 is a diagram of the bouncing device 410 according to the present invention when bounced. The seat 100 is located at a first position before the child chair 1 performs bouncing function (shown in FIG. 12). When the seat 100 receives the force or the gravity force from child, the spring 4108 is compressed and the seat 100 is located at a second position. The compressed spring 4108 has a bias force so that the seat 100 will be moved back to the first position so that the seat 100 is reciprocated upward and downward to move curvedly at this moment for performing bouncing function. When the child chair 1 performs bouncing function by the bouncing devices 410, the seat 100 can be rotated relative to the frame 200 via the pivot point 102, the first pivot points 4112 and the second pivot points 4114. In this embodiment, the backrest 1002 and the seat body 1004 is integrated so that the all seat 100 will move relative to the frame 200 rather than backrest 1002 or seat body 1004 only, so that the child sitting thereon will bounce together with seat 100 to increase the comfortable.

When the child chair 1 works as a high chair, the actuator 310 is located at the second position B and the reclining adjusting device 300 may set in the locking status, the seat 100 is fixed at a predetermined reclining position relative to the frame 200. At this time, the adjusting pin 3508 of the reclining adjusting device 300 is engaged with one of the slots 3510. To adjust the reclining angle of the seat 100, the operating portion 3106 is pressed so as to pull the actuator 310 to the first position A. At this time, the second end 3518 of the adjusting part 3512 is rotated via the bolt 3520 by the cable 3108. The elastic part 3514 is transformed after the adjusting part 3512 rotated. The adjusting pin 3508 is deviated from the slot 3510 and into the slide way 3506. The seat 100 is then adjustable the reclined angle relative to the frame 200 freely. When the operating portion 3106 is released, the drag rod 3104 is moved back to the second position B (the reclining adjusting device 300 is back to the locking status) via the elastic element 3110. The elastic part 3514 provides the elasticity so as to move the adjusting pin 3508 into other slot 3510. The seat 100 is fixed at the specific reclining angle at this moment. However, when the child chair 1 is adjusted the reclining angle, user can presses the operating portion 3106 only and retains the reclining adjusting device 300 in the release status and move the seat 100 to another predetermined reclining angle at the same time. User does not have to operate the locking device 3102. The foot rest 500 is adjusted different position relative to the seat 100 for increase comfort to the child while the child chair 1 is reclined or worked as a bouncing chair.

Figure 14:
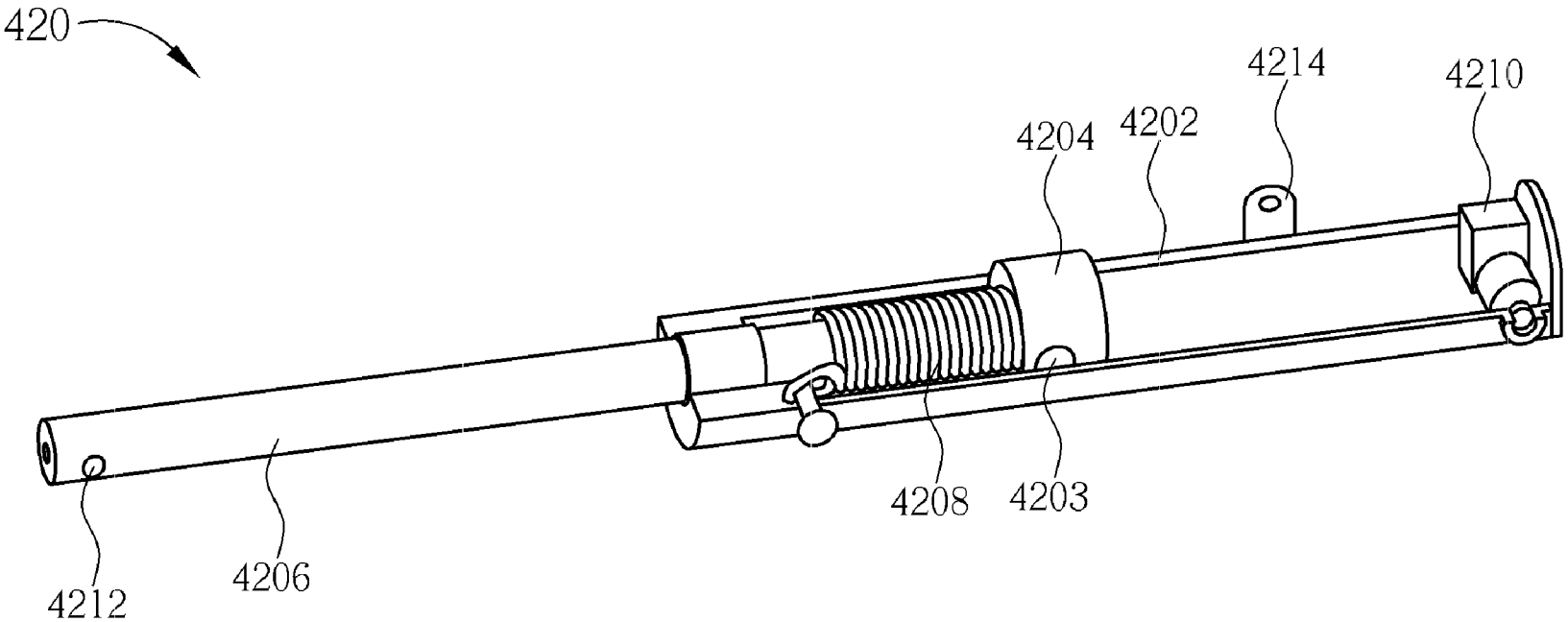
FIG. 14 is a diagram of the bouncing device according to the present invention when bounced.

In addition to use the compression spring in the bouncing device, a tension spring can be used. Please refer to FIG. 14. FIG. 14 is a fragmentary exploded of the second embodiment of a bouncing device 420 according to the present invention. The bouncing device 420 is similar as the first embodiment that is mounted at the bottom of the seat 100 and includes a sleeve 4202, a column 4206, a spring 4208, a piston 4204, and a fixed cover 4210. The sleeve 4202 also includes a second pivot point 4214, and the fixed cover 4210 is also mounted on the bottom of the sleeve 4102. Additionally, the second pivot point 4214 of the sleeve 4202 is also pivoted with the support tube 240 of the frame 200 by the rivet (not shown in FIG. 14), and the end of the column 4206 includes a first pivot point 4212, which is pivoted with the seat 100 by the rivet (not shown in FIG. 14). However, the end of the column 4206 is passing through the spring 4208, and is connected to the piston 4204 by the rivet 4203. The spring 4108 of the bouncing device 410 in the first embodiment is a compression spring, and the spring 4208 of the bouncing device 420 in the second embodiment is a tension spring. The movable distance of the piston 4204 of the bouncing device 420 is longer than the bouncing device 410 because the spring 4208 is the tension spring, and the piston 4204 has better stability in the sleeve 4202. So that the seat 100 will more stable when it is bounced.

The second pivot points 4114, 4214 can form on the side of the sleeve 4102, 4202 or on the bottom of the sleeve 4102, 4202, as long as the bouncing devices 410, 420 are pivoted between the seat 100 and the support tube 240 to bounce the seat 100.

Figure 15:
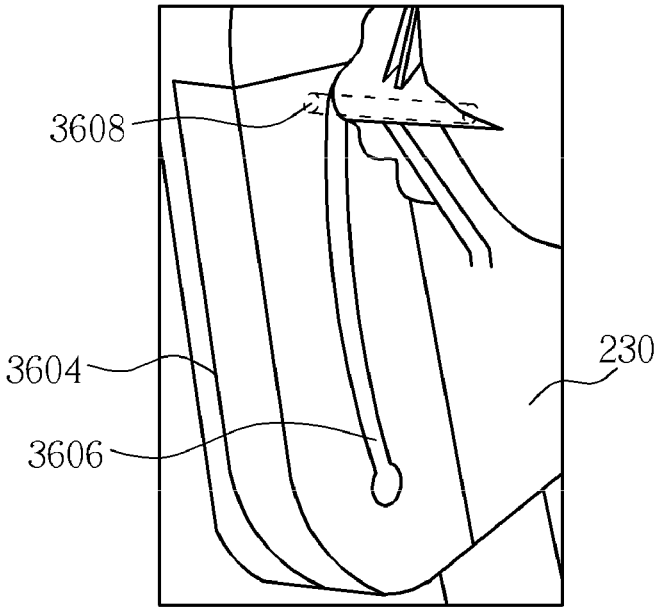
FIG. 15 is a lateral view of the second embodiment of the engaging device according to the present invention.
Figure 16:
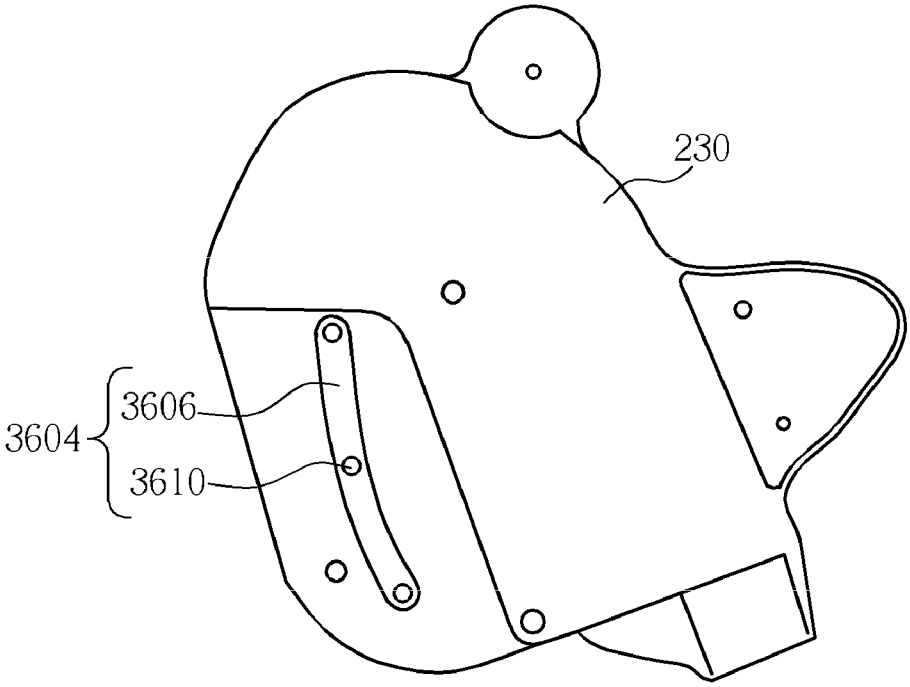
FIG. 16 is a diagram of the angle adjusting device according to the present invention.
Figure 17:
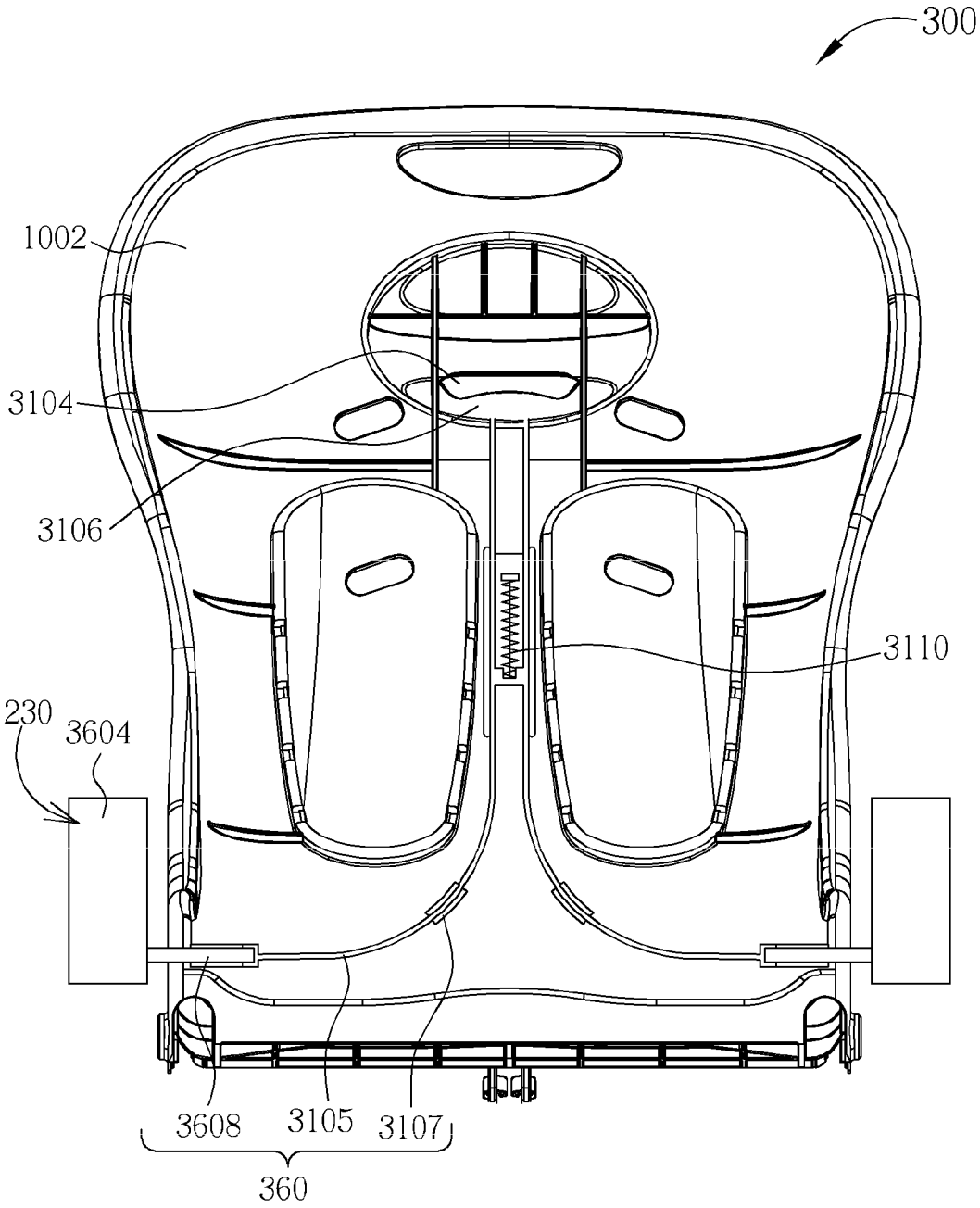
FIG. 17 is a diagram of the second embodiment of the reclining adjusting device according to the present invention.

Please refer to FIG. 15 to FIG. 17. FIG. 15 is a lateral view of the second embodiment of the engaging device 360 according to the present invention. FIG. 16 is a diagram of the adjusting device 3604 according to the present invention. FIG. 17 is a diagram of the engaging device 360 and the reclining adjusting device 300 according to the present invention. The reclining adjusting device 300 includes the actuator 310 and an engaging device 360 which is connected to the actuator 310. The actuator 310 includes the drag rod 3104 and the elastic element 3110. The operating portion 3106 is formed at the top end of the drag rod 3104, and two flexible members 3105 is form on the bottom end of the drag rod 3104. The two flexible members 3105 are extended respectively to the two sides of the seat 100 by two stabilizing members 3107 on the seat 100 by the flexible members 3105. The end of each flexible member 3105 secured an adjusting pin 3608 that forms as the engaging device 360. The seat coupled 230 of the frame 200 includes an adjusting device 3604, which includes a slide way 3606 and a plurality of slots 3610 which are communicated with the slide way 3606. When the adjusting pin 3608 is located in one of the slots 3610, the seat 100 is fixed at a predetermined reclined angle relative to the frame 200. To adjust the seat 100, pressing the operating portion 3106 so as to move the adjusting pin 3608 away deviated from the slots 3610 and into the slide way 3606 by the flexible member 3105. The seat 100 is moved to a desired reclined angle then the operating portion 3106 is released. The elastic element 3110 has the bias force so that the drag rod 3104 is moved back to the locking status at this moment. The adjusting pin 3608 is moved and engages with another one of the slots 3610, and the seat 100 is fixed in another the reclined angle then.

Figure 18:
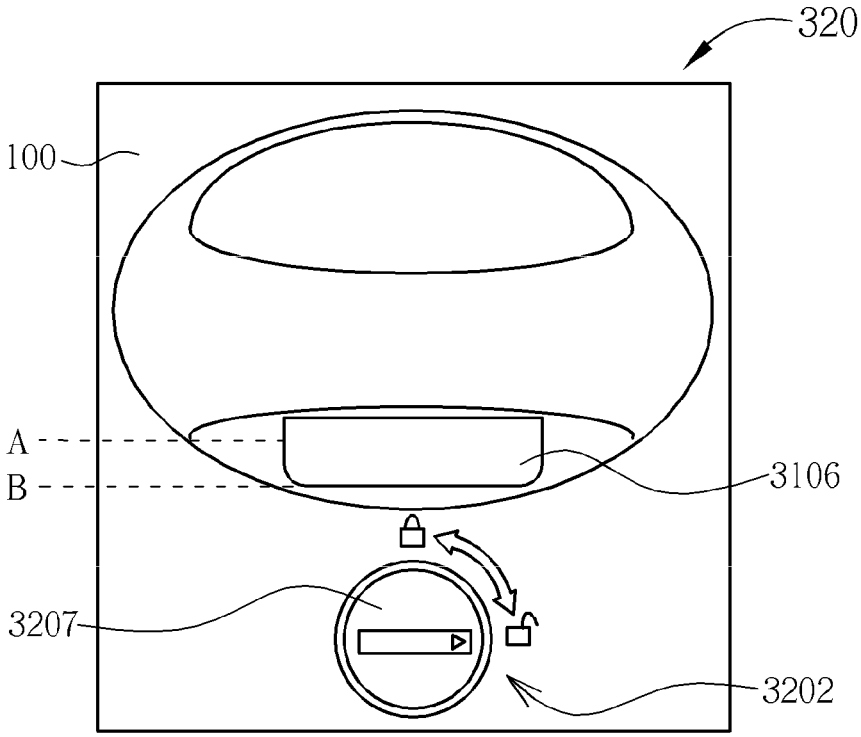
FIG. 18 is an anterior view of the second embodiment of the locking device in the locking status according to the present invention.
Figure 19:
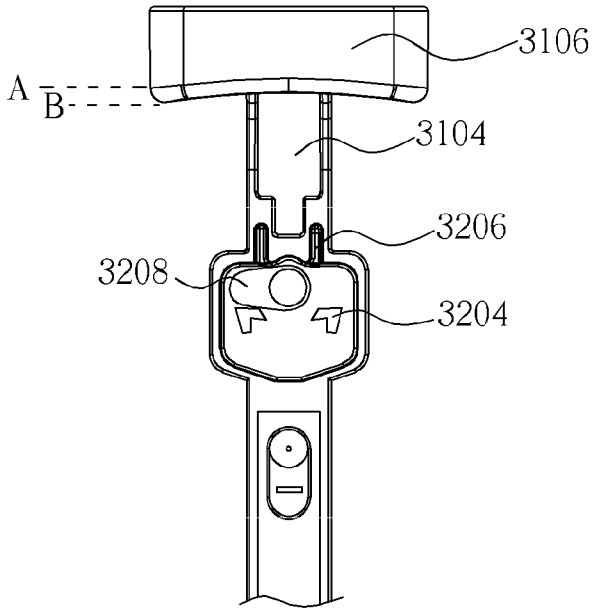
FIG. 19 is a posterior of the locking device in the locking status according to the present invention.
Figure 20:
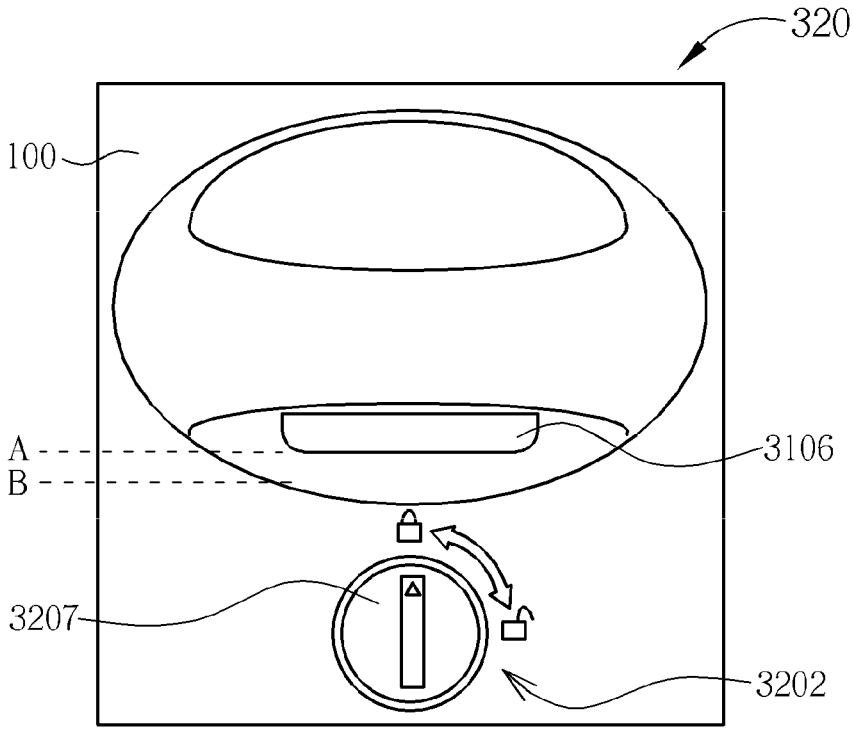
FIG. 20 is an anterior view of the locking device in the release status according to the present invention.
Figure 21:
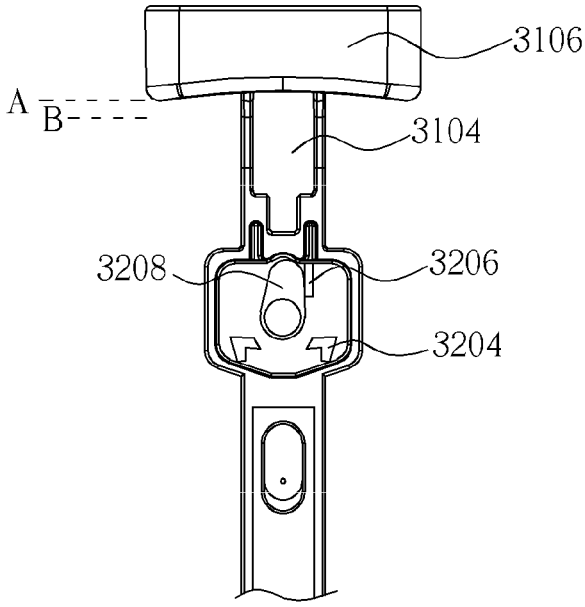
FIG. 21 is a posterior of the locking device in the release status according to the present invention.
Figure 22:
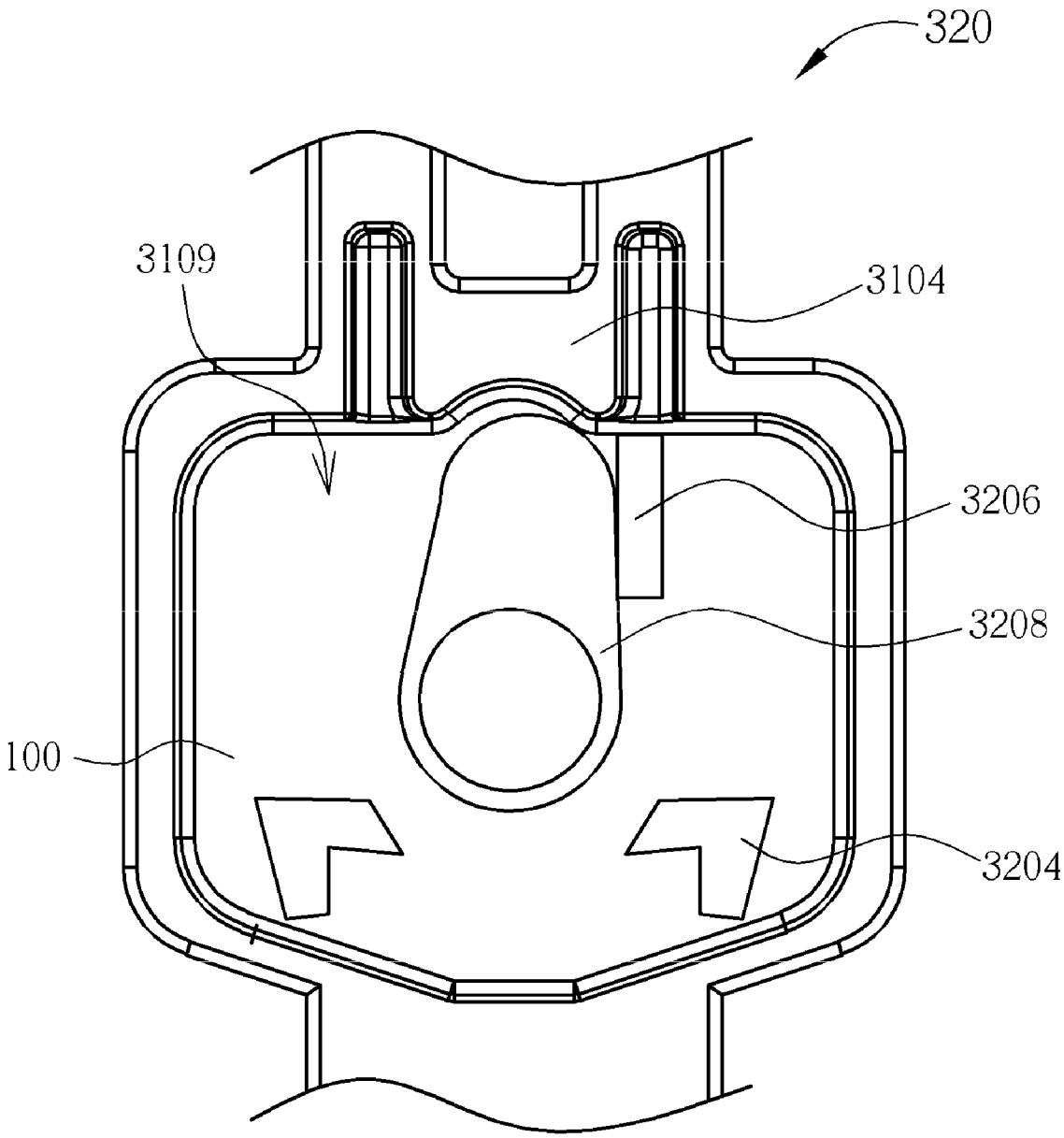
FIG. 22 is a partial-enlarged diagram of the locking device according to the present invention.

Please refer to FIG. 18 to FIG. 22. FIG. 18 is a posterior view of the second embodiment of the locking device 3202 in the locking status according to the present invention. FIG. 19 is a perspective of the locking device 3202 in the locking status according to the present invention. FIG. 20 is a posterior view of the locking device 3202 in the release status according to the present invention. FIG. 21 is a perspective of the locking device 3202 in the release status according to the present invention. FIG. 22 is a partial-enlarged diagram of the locking device 3202 according to the present invention. The second embodiment of the locking device 3202 is a knob, which includes an operating part 3207 and a retaining part 3208, wherein the operating part 3207 is mounted on the back of the backrest 1002; the retaining part 3208 is mounted on the inner side of the backrest 1002 and is fixed with the operating part 3207. A positioning part 3109 is formed below the operating portion 3106 of the drag rod 3104 for containing the retaining part 3208. The locking device 3202 can be rotated between a retained position (shown in FIG. 20) and an unretained position (shown in FIG. 18). The inner side of backrest 1002 further includes a first protrusion 3204 and a second protrusion 3206 for retaining the position of the locking device 3302 (shown in FIG. 22). When the locking device 3302 is retained at the retained position, the retaining part 3208 is in the upright status and keep the drag rod 3104 at the first position A and the reclining adjusting device 300 in the release status. Then the seat 100 can perform bouncing function. When the locking device 3302 is at the unretained position, the child chair 1 can work as a high chair and the seat 100 is adjustable in different reclined angle while the user operates the actuator 310.

Referring to FIG. 20, when the drag rod 3104 is located at the first position A, the engaging device 350 is removed from the frame 200. When the drag rod 3104 is located at the second position B, the engaging device 350 is engaged with the frame 200 (shown in FIG. 18). Referring to FIG. 20 and FIG. 21, the operating portion 3104 is pressed to move the drag rod 3104 to the first position A, and then the operating part 3207 is retained to the retained position (the operating part 3207 is retained by the second protrusion 3206). The retaining part 3208 of the locking device 3202 is in the upright status to abut against the drag rod 3104 located at the first position A, and then the adjusting pin 3608 is deviated from the slots 3610 and entered into the slide way 3606 for allowing the adjusting pin 3608 is moved freely within the slide way 3606. The child chair 1 is pressed by the child sitting thereon or the parents, and the seat 100 is forced to bounce relative to the frame 200 by the spring 4108 of the bouncing device 410 and the seat 100 is rotated relative to the frame 200 around the pivoted axis 102. When the operating part 3207 rotates to the unretained position (the operating part 3207 is retained by the first protrusion 3204), the elastic element 4108 has the bias force to promote the drag rod 3104 back to the second position B. The adjusting pin 3608 is deviated from the slide way 3606 and entered into the slots 3610, and the seat 100 is secure in the fixed position.

Figure 23:
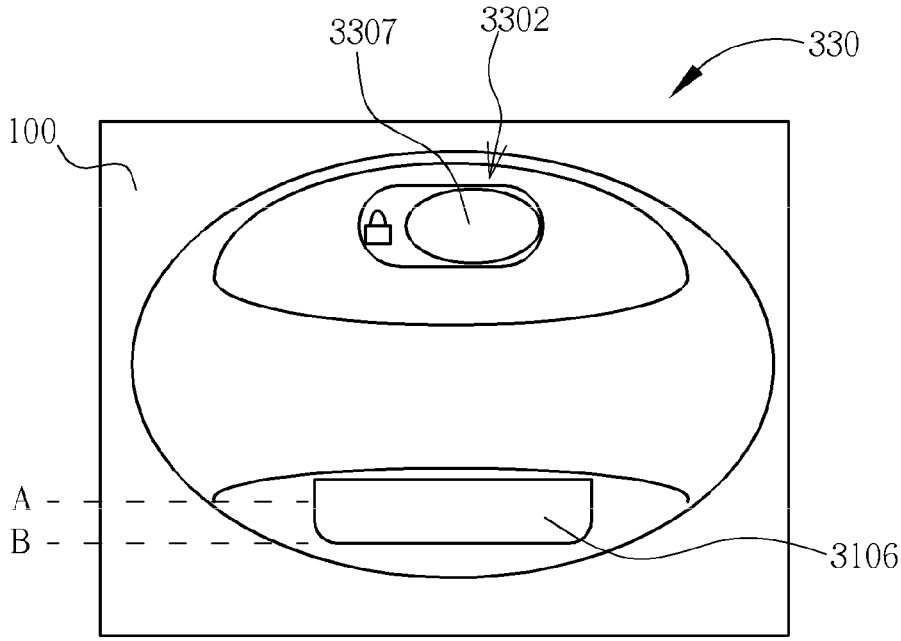
FIG. 23 is an anterior view of a third embodiment of the locking device in the locking status according to the present invention.
Figure 24:
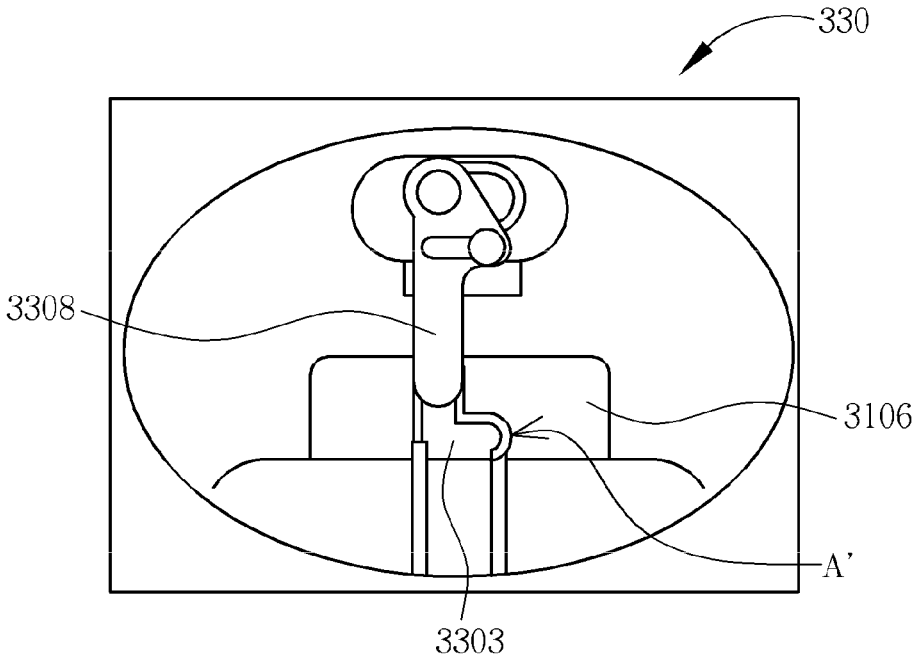
FIG. 24 is a posterior of the locking device in the locking status according to the present invention.
Figure 25:
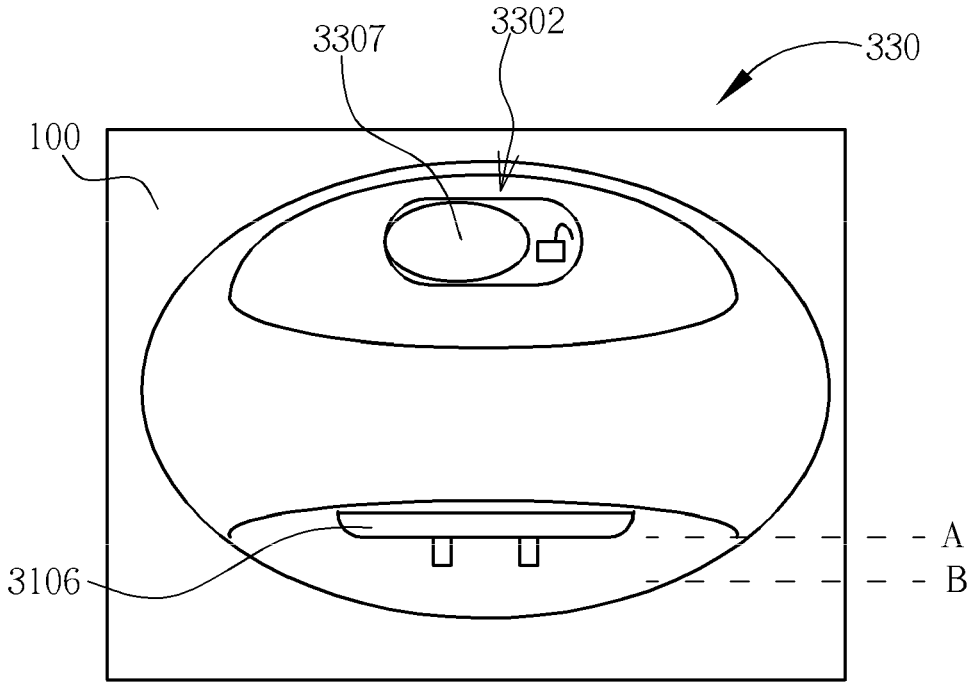
FIG. 25 is an anterior view of the locking device in the release status according to the present invention.
Figure 26:
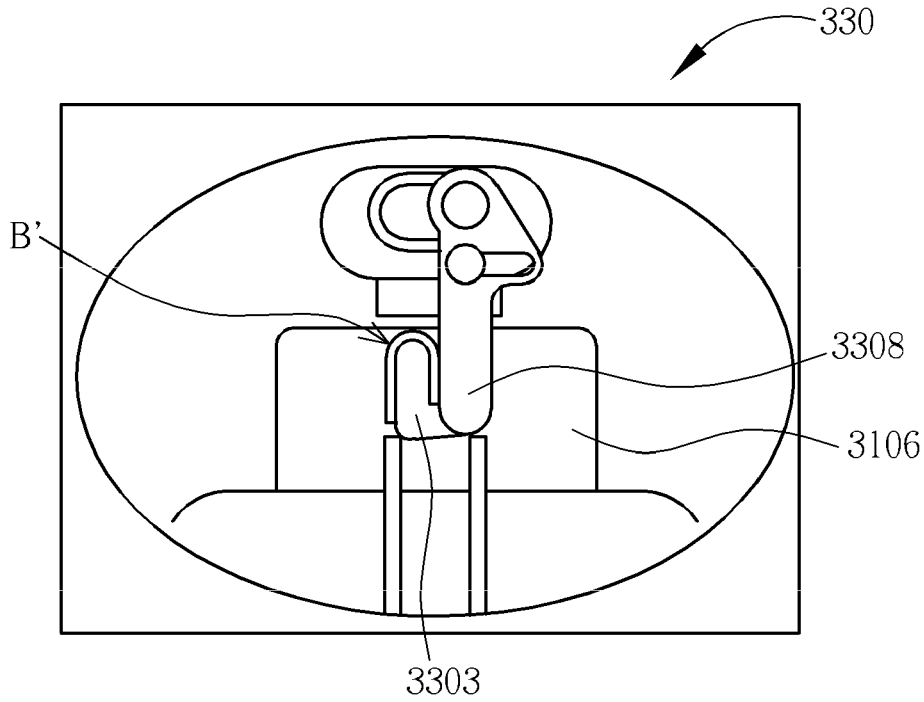
FIG. 26 is a posterior of the locking device in the release status according to the present invention.
Figure 27:
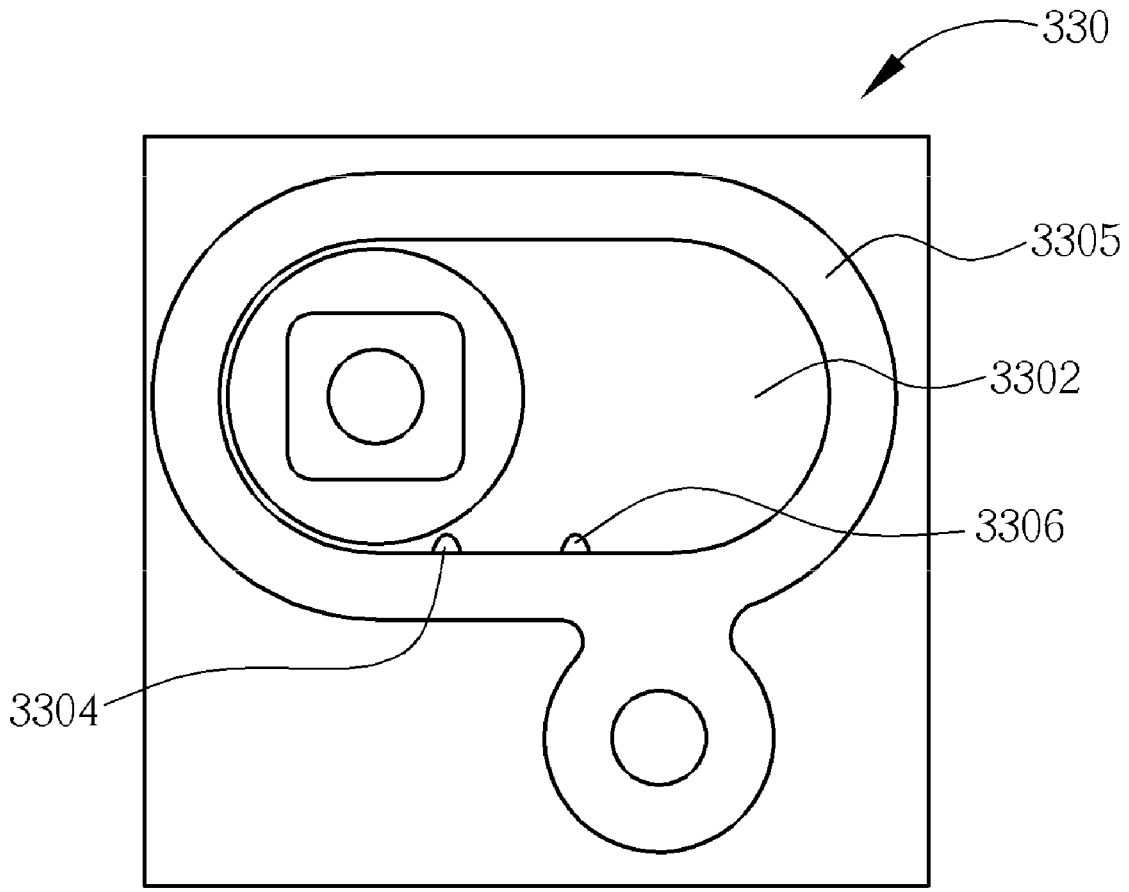
FIG. 27 is a partial-enlarged diagram of the locking device according to the present invention.

Please refer to FIG. 23 to FIG. 27. FIG. 23 is a posterior view of a third embodiment of the locking device 3302 in the locking status according to the present invention. FIG. 24 is a perspective of the locking device 3302 in the locking status according to the present invention. FIG. 25 is a posterior view of the locking device 3302 in the release status according to the present invention. FIG. 26 is a perspective of the locking device 3302 in the release status according to the present invention. FIG. 27 is a partial-enlarged diagram of the locking device 3320 according to the present invention. The locking device 3302 is a button which slides transversely relative to a seat 100, and is mounted on the seat 100 in a piercing manner. The locking device 3302 includes an operating part 3307 and a retaining part 3308, wherein the operating part 3307 is mounted on the back side of the backrest 1002; the retaining part 3308 is mounted on the inner side of the backrest 1002 and is fixed with the operating part 3307. The operating part 3307 can be rotated between a retained position (shown in FIG. 25) and an unretained position (shown in FIG. 23). One of the retaining parts 3308 is mounted on the operating portion 3106. The operating portion 3106 includes a slot 3303, and the end of the retaining part 3308 slides in the slot 3303. The slot 3303 is formed with a first abutting end A' and a second abutting end B', and the first abutting end A' and the second abutting end B' have different height. An opening wall 3305 is mounted on the seat 100 includes a first protrusion 3304 and a second protrusion 3306 for retaining the position of the locking device 3302 (shown in FIG. 27). Referring to FIG. 25, the drag rod 3104 is moved to the first position A, and then the operating part 3307 is moved to the retained position which is retained by the second protrusion 3306. At this time, the retaining part 3308 of the locking device 3302 is abutted against with the first abutting end A', and the adjusting pin 3608 is deviated from the slots 3610 entered and into the slide way 3606. The seat 100 can be performed bouncing function. When the locking device 3302 is moved to the unretained position and is retained by the first protrusion 3304 shown in FIG. 23 and in FIG. 24), the drag rod 3104 is moved back to the second position B and the segment 3308 of the locking device 3302 is abutted against the second abutting end B'. The adjusting pin 3608 is deviated from the slide way 3606 and entered into the slots 3610 by the bias force of the elastic element 3110.

Figure 28:
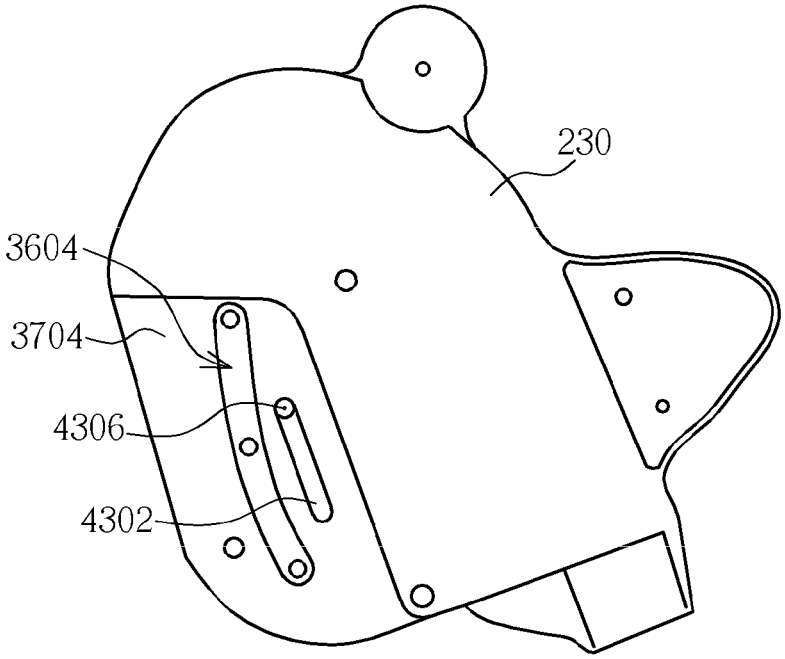
FIG. 28 is a diagram of the third embodiment of the bouncing device according to the present invention.
Figure 29:
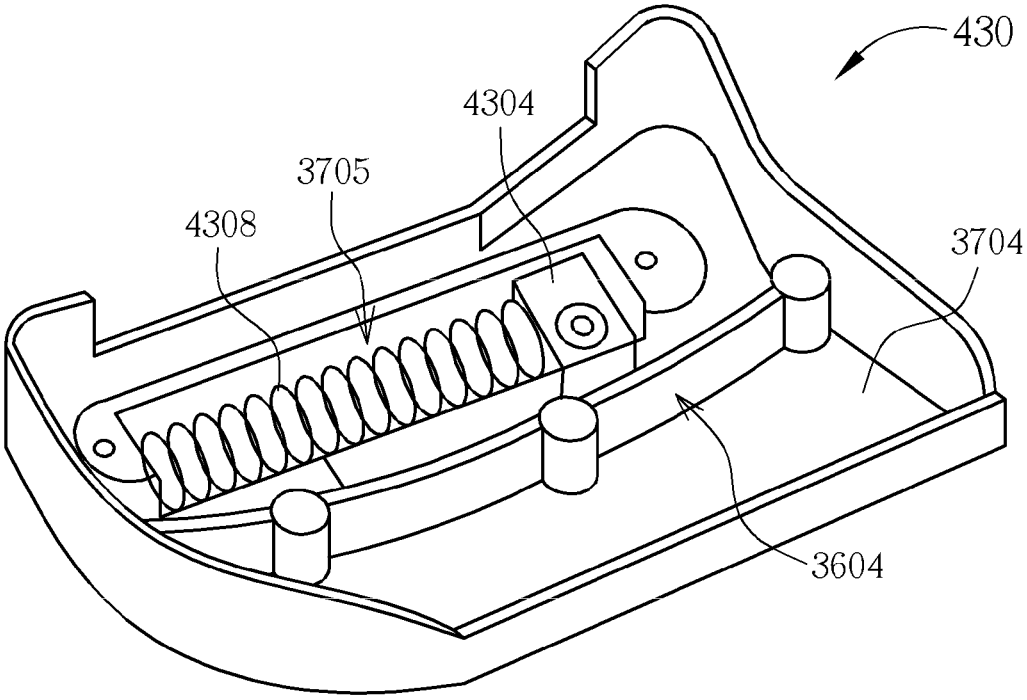
FIG. 29 is a fragmentary sectional view of the bouncing device according to the present invention.
Figure 30:
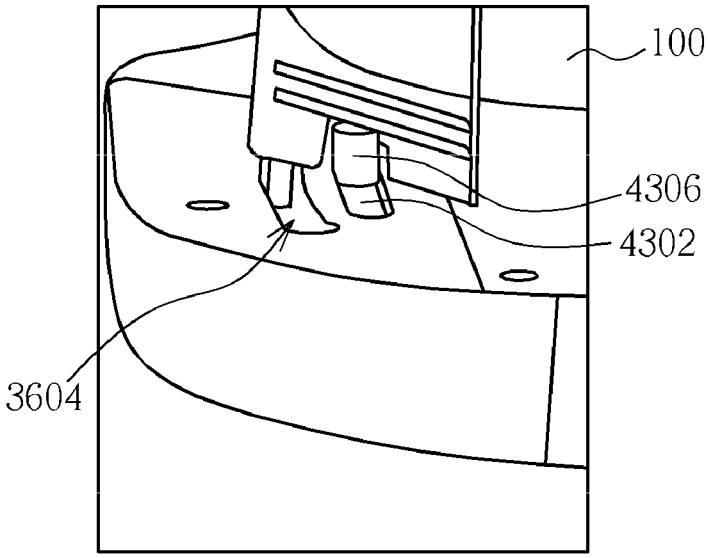
FIG. 30 is a lateral view of the bouncing device according to the present invention.
Figure 31:
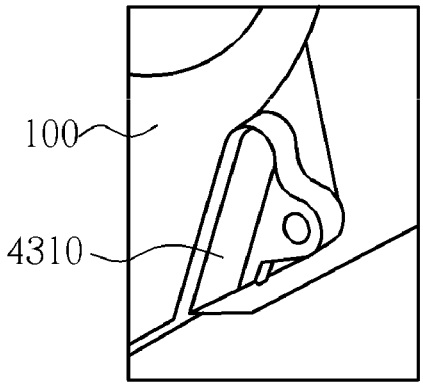
FIG. 31 is a diagram of a groove disposed on the seat according to the present invention.

The spring of the bouncing device not only can be provide with compressing spring or tension spring but also other spring or elastic device. Please refer to FIG. 28 to FIG. 31. FIG. 28 is a diagram of the third embodiment of the bouncing device 430 according to the present invention. FIG. 29 is a fragmentary sectional view of the bouncing device 430 according to the present invention. FIG. 30 is a lateral view of the bouncing device 430 according to the present invention. FIG. 31 is a diagram of the groove 4310 mounted on the seat 100 according to the present invention. The bouncing device 430 is mounted between the two sides of the seat 100 and the he seat coupler 230. The seat coupler 230 of the frame 200 includes an adjustor part 3704, having a cover and forming a space 3705 with the seat coupler 230. The bouncing device 430 is mounted in the space 3705. The adjustor part 3704 is formed the adjusting device 3604, and is formed with a channel 4302 near the adjusting device 3604. The bouncing device 430 includes the bouncing seat 4304, and a spring 4308. The bouncing seat 4304 is slidable connected to the adjustor part 3704 and includes a protruding part 4306 projecting out of the channel 4302. The spring 4308 is a compression spring of the third embodiment of the bouncing device 430, and the spring 4308 is mounted in the adjustor part 3704. One end of the spring 4308 is connected to the bouncing seat 4304, and the other end is connected to the side wall of the adjustor part 3704. Referring to the FIG. 30 and FIG. 31, the seat 100 includes a groove 4310, which is engaged with the protruding part 4306. When the reclining adjusting device 300 is retained in the release status, the seat 100 is provided a force to and the wall of the groove 4310 is pressed the protruding part 4306. The spring 4308 is then compressed to perform bouncing function.

Figure 32:
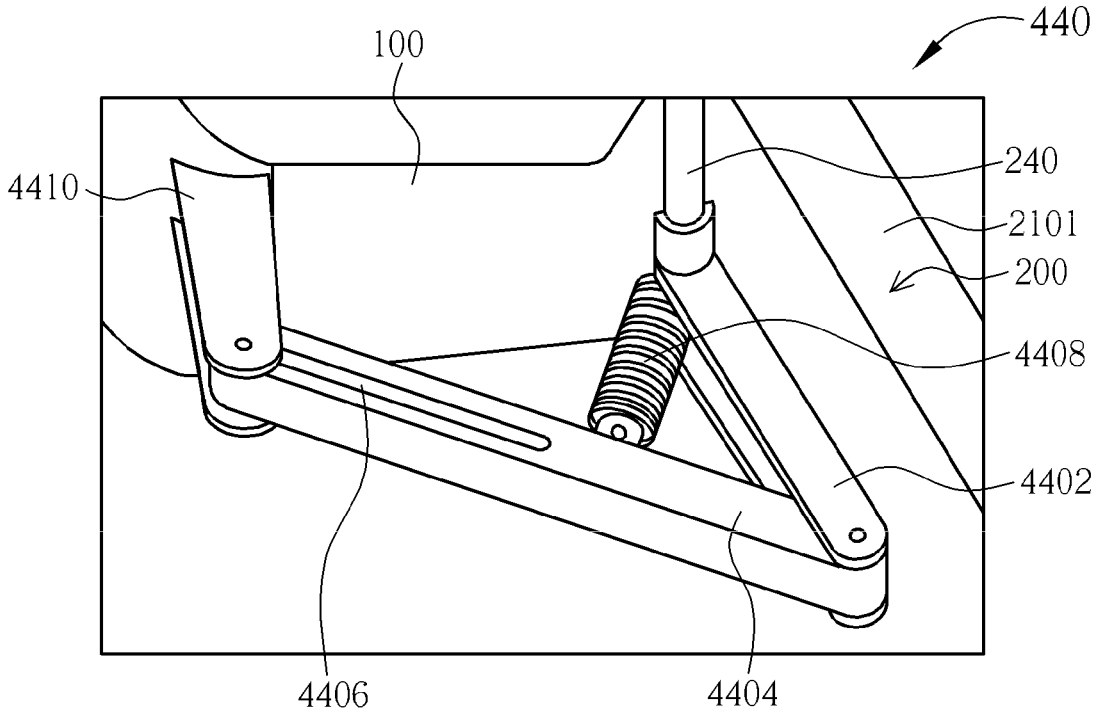
FIG. 32 is a diagram of a fourth embodiment of the bouncing device according to the present invention.
Figure 33:
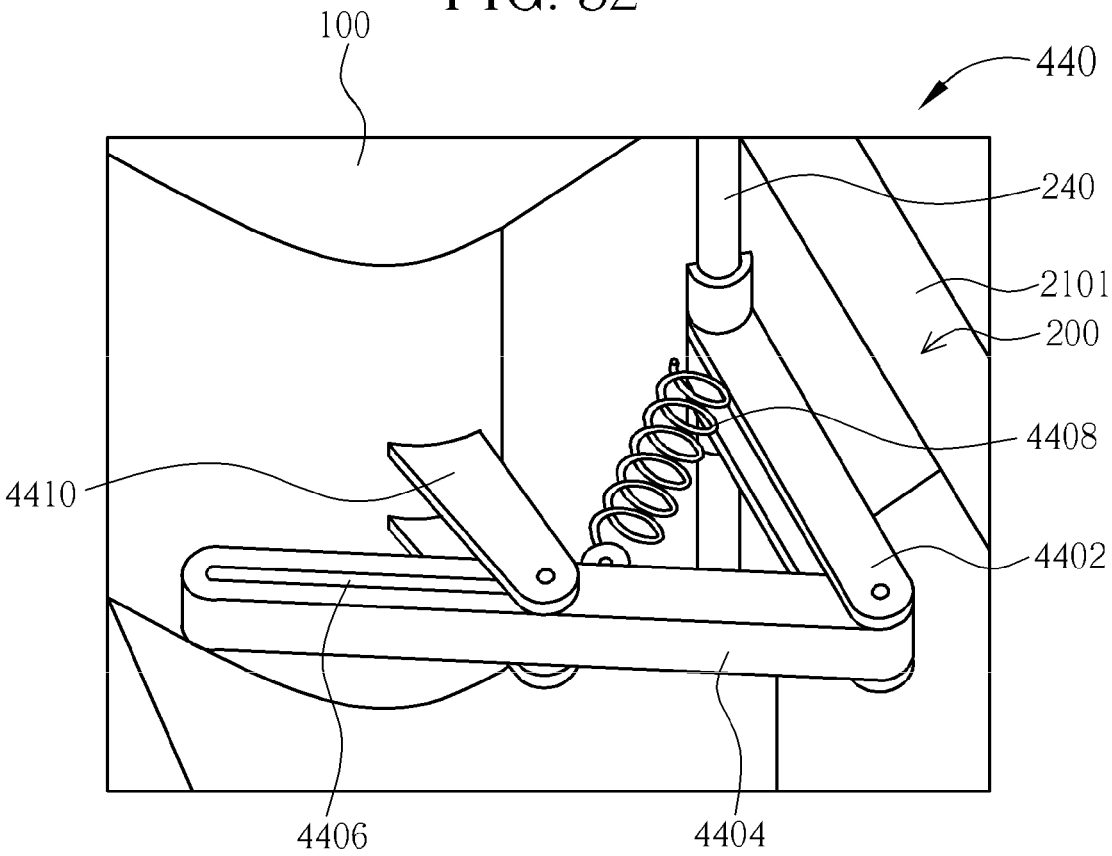
FIG. 33 is a diagram of the bouncing device according to the present invention when bounced.

Please refer to FIG. 32 and FIG. 33. FIG. 32 is a diagram of the fourth embodiment of the bouncing device 440 according to the present invention. FIG. 33 is a diagram of the bouncing device 440 according to the present invention when bounced. The bouncing device 440 includes a support seat 4402, a support rod 4404, a spring 4408, and a connecting ear 4410. The first end of the support seat 4402 is fixed with the support tube 240 of the frame 200, and the second end is pivoted with the first end of the support rod 4404. The second end of the support rod 4404 has a slot 4406. The spring 4408 of the fourth embodiment is a compression spring, connecting between the first end of the support seat 4402 and the support rod 4404. The first end of the connecting ear 4410 is mounted on the seat 100, and the second end is disposed movably in the slot 4406. When the child chair 1 is used as the bouncing chair, the spring 4408 is in an original status first (shown in FIG. 32). The second end of the connecting ear 4410 is located on the first end of the slot 4406 and the seat 100 is in the higher position. When the reclining adjusting device 300 is retained in the release status and the seat 100 is provided with a force, the second of the connecting ear 4410 can slide along the slot 4406 of the support rod 4404 (shown in FIG. 33) to the second end. At this time, the spring 4408 has the bias force so that the connecting ear 4410 can slide back to the original position, and the seat 100 can be bounced along the direction relative to the frame 200.

The springs 4108, 4208, 4308, 4408 of the bouncing devices 410, 420, 430, 440 are not limited to the assembly disclosed in the aforementioned embodiments. The spring can also be a torque spring mounted on the pivot axis 102 that is between the two sides of the seat 100 and the correspondent coupler 230. Two ends of the spring are connected to the seat 100 and the coupler of the frame respectively. The coupler 230 may have a cover to cover between the seat 100 and frame 200 so as to prevent a jamming hole to left.

Following the above-mentioned, the child chair of the present invention has functions of a high chair and a bouncing chair, and the child chair can switch the reclining adjusting device and the bouncing device easily. Although the child chair of the first embodiment and the second embodiment uses different reclining adjusting devices, different bouncing devices, and locking devices, it should be noted that the child chair of the present invention is not limited to the way one reclining adjusting device combines to the other bouncing device or locking device disclosed in the aforementioned embodiments. It would be obvious for those skilled in the art to swap different components from the disclosed assembly to generate other designs according to the demand of the product.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A child chair comprising:

a frame;

a seat pivoted with the frame, the seat comprising:

a backrest; and a seat body for supporting a child sitting thereon;

a reclining adjusting device mounted on the seat capable of moving between a locking status and a release status, the backrest and the seat body of the seat synchronously movable relative to the frame when the reclining adjusting device is in the release status;

a locking device mounted on the seat for retaining the reclining adjusting device in the release status; and a bouncing device mounted between a rear portion of the seat and the frame for bouncing the seat along a direction relative to the frame only when the reclining adjusting device is retained in the release status by the locking device.

2. The child chair according to claim 1, wherein the reclining adjusting device comprises:

an actuator mounted on the seat; and an engaging device connected with the actuator for selectively engaging with the frame so as to secure the seat to the frame in different reclining positions.

3. The child chair according to claim 2, further comprising an operating portion, wherein the operating portion comprises a slot formed with a higher first abutting end and a lower abutting second end, the locking device slidably mounted on the seat and comprising a retaining part movable within the slot.

4. The child chair according to claim 2, wherein the locking device is movable between a retained position and an unretained position, and the locking device retains the reclining adjusting device in the release status when the locking device is in the retained position.

5. The child chair according to claim 4, wherein the actuator comprises a drag rod having an operating portion at the top.

6. The child chair according to claim 5, wherein the locking device is rotatably mounted on the seat and near the bottom of the drag rod on the seat.

7. The child chair according to claim 4, wherein the frame comprises a slide way and a plurality of slots communicating with the slide way, the engaging device comprising an adjusting pin for engaging with one of the slots and the adjusting pin securing the seat relative to the frame when the reclining adjusting device is in the locking status; the adjusting pin is set in the slide way and the seat is movable relative to the frame when the reclining adjusting device is set in the release status.

8. The child chair according to claim 7, wherein the engaging device comprises:

an adjusting part pivoted to the seat and comprising a first end linked with the actuator and a second end where the adjusting pin is located; and an elastic part connected to the adjusting part and the seat;

wherein when the reclining adjusting device is moved from the locking status to the release status, the adjusting part is rotated relative to the seat and the adjusting pin is brought from one of the slots to the slide way.

9. The child chair according to claim 1, wherein the locking device is moveable between a retained position and an unretained position, and the locking device retains the reclining adjusting device in the release status when the locking device is in the retained position.

10. The child chair according to claim 9, further comprising a drag rod, wherein the drag rod comprises a positioning part, the locking device rotatably mounted on the seat and comprising a retaining part contained in the positioning part, the retaining part abutted against the positioning part for retaining the drag rod at a higher position when the locking device in the retained position.

11. The child chair according to claim 1, wherein the bouncing device comprises:

a sleeve pivoted with the frame;

a column with one end movably disposed in the sleeve and with another end pivoted with the seat; and a spring disposed in the sleeve connected between the bottom of the sleeve and the column.

12. The child chair according to claim 1, wherein the bouncing device comprises:

a sleeve pivoted with the frame;

a column with one end movably disposed in the sleeve and with another end pivoted with the bottom of the seat;

a piston movably disposed in the sleeve and fastened to the end of the column; and a spring disposed in the sleeve and sleeved on the end of the column, the two end of the spring is connected to the sleeve and the piston respectively.

13. The child chair according to claim 12, wherein the spring is a tension spring.

14. The child chair according to claim 1, wherein the bouncing device is mounted between the two sides of the seat and a correspondent seat coupler of the frame.

15. The child chair according to claim 14, wherein the bouncing device comprising:

a channel disposed on the seat couplers;

a bouncing seat slidable disposed in the seat couplers and comprises a protruding part projecting out of the channel; and a spring disposed in the seat couplers and connected to the bouncing seat;

wherein when the reclining adjusting device is retained in the release status by the locking device, the seat is provided with a force so as to press the protruding part of the bouncing seat.

16. The child chair according to claim 15, wherein the two sides of the seat are pivoted with the seat couplers via a pivot axle respectively, the bouncing device comprising a torque spring mounted on the pivot axle.

17. The child chair according to claim 1, wherein the frame comprises:

a front leg frame;

a rear leg frame connected with the front leg frame;

two seat couplers disposed at two sides of the front leg frame; and a support tube connected with the two seat couplers, the bouncing device disposed between the seat and the support tube.

18. The child chair according to claim 17, wherein the bouncing device comprises:

a support seat with a first end fixed with the support tube;

a support rod with one end pivoted with a second end of the support seat and having a slot at the other end;

a spring connected between the first end of the support seat and the support rod; and a connecting ear mounted on the seat and movably in the slot;

wherein when the reclining adjusting device is retained in the release status by the locking device, the connecting ear can slide in the slot and stretch the elastic part for bouncing the seat.

19. A child chair comprising:

a frame;

a seat pivoted with the frame, the seat comprising:

a backrest; and a seat body for supporting a child sitting thereon;

a device mounted on the seat selectively moved between a first position and a second position, the backrest and the seat body of the seat capable of synchronously moving relative to the frame when the device is in the second position, wherein the device comprises a reclining adjusting device, and the reclining adjusting device is operable for adjusting the reclining angle of the seat relative the frame when the device is in the second position; and a bouncing device mounted between a rear portion of the seat and the frame;

wherein only when the device is in the second position is the seat bounced relative to the frame by the bouncing device while the seat is provided with a force.

20. The child chair according to claim 19, wherein the frame comprises:

two seat couplers pivoted respectively with two sides of the seat; and a support tube connected to the two seat couplers;

wherein two ends of the bouncing device are connected respectively with the seat and the support tube.

21. The child chair according to claim 19, wherein the frame comprises two seat couplers pivoted respectively with two sides of the seat, the bouncing device mounted between the two sides of the seat and the correspondent seat coupler of the frame.

22. The child chair according to claim 21, wherein the sides of the seat is pivot with the correspondent seat coupler of the frame by a pivot axle, the bouncing device is mounted on the pivot axle.

23. A child chair comprising:

a frame;

a seat pivoted with the frame, the seat comprising:

a backrest; and a seat body for supporting a child sitting thereon;

a bouncing device mounted between a rear portion of the seat and the frame for bouncing the backrest and the seat body of the seat relative to the frame;

a locking device mounted on the seat and movable between a retained position and an unretained position for converting the child chair between a bouncing chair and a high chair; and a reclining adjusting device mounted on the seat, the seat movable relative to the frame via the reclining adjusting device to realize the high chair when the locking device is located in the unretained position, the seat bounced relative to the frame to realize the bouncing chair when the locking device is located in the retained position;

wherein the seat bounces relative to the frame only when the locking device is in the retained position.

24. The child chair according to claim 23, wherein the frame comprises a slide way and at least one slot communicating with the slide way, the seat comprises an engaging device movable between the slide way and the slot, when the locking device is located in the unretained position, the engaging device is engaged with the slot so as to secure the seat relative to the frame, when the locking device is in the retained position, the engaging device is slidable freely within the slide way so that the seat is bounced relative to the frame.

25. A child chair comprising:

a frame;

a seat pivoted with the frame via an axle;

a bouncing device mounted between a rear portion of the seat and the frame for bouncing a backrest and a seat body of the seat relative to the frame;

a locking device mounted on the seat and movable between a retained position and an unretained position; and a reclining adjusting device mounted on the seat capable of moving between a locking status and a release status, the backrest and the seat body of the seat synchronously movable relative to the frame when the reclining adjusting device is in the release status;

wherein only when the locking device is at the retained position is the seat bounced relative to the frame by the bouncing device and rotated relative to the frame via the axle.

* * * * *